US009199477B2

(12) United States Patent
Kanbe et al.

(10) Patent No.: US 9,199,477 B2
(45) **Date of Patent: *Dec. 1, 2015**

(54) INK CONTAINING DEVICE AND INK SUPPLY DEVICE

(71) Applicant: Brother Kogyo Kabushiki Kaisha, Nagoya-shi, Aichi-ken (JP)

(72) Inventors: Tomohiro Kanbe, Nagoya (JP); Yuki Takagi, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/586,599

(22) Filed: Dec. 30, 2014

(65) Prior Publication Data

US 2015/0183224 A1 Jul. 2, 2015

Related U.S. Application Data

(63) Continuation of application No. 13/843,518, filed on Mar. 15, 2013, now Pat. No. 8,939,561.

(30) Foreign Application Priority Data

Apr. 19, 2012 (JP) ..... 2012-095698

(51) Int. Cl.
*B41J 2/14* (2006.01)
*B41J 2/175* (2006.01)

(52) U.S. Cl.
CPC ..... *B41J 2/17526* (2013.01); *B41J 2/1752* (2013.01); *B41J 2/1755* (2013.01); *B41J 2/17513* (2013.01); *B41J 2/17553* (2013.01); *B41J 2/17566* (2013.01); *B41J 2002/17576* (2013.01)

(58) Field of Classification Search
USPC ..... 347/49, 86
See application file for complete search history.

(56) References Cited

U.S. PATENT DOCUMENTS 6,070,975 A * 6/2000 Uchikata et al. ..... 347/86
6,209,996 B1 4/2001 Gasvoda et al.

(Continued)

FOREIGN PATENT DOCUMENTS

CN 101254703 A 9/2008
CN 101412319 A 4/2009

(Continued)

OTHER PUBLICATIONS

State Intellectual Property Office of The People's Republic of China, Notification of First Office Action for Chinese Patent Application No. 201310106626.6 (counterpart to co-pending U.S. Appl. No. 13/843,518), issued Sep. 15, 2014.

*Primary Examiner* — Anh T. N. Vo
(74) *Attorney, Agent, or Firm* — Baker Botts L.L.P.

(57) ABSTRACT

An ink containing device includes an ink cartridge and an adaptor. The ink cartridge includes a first main body having a first surface facing a first direction and a chamber that stores ink, an ink outlet portion disposed on the first surface of the first main body and that directs the ink from the chamber to an exterior of the first main body; and an ink detecting portion that detects an amount of the ink stored into chamber. The adapter is attachable to the ink cartridge. The adapter includes a second main body and a movable member that at with respect to the second main body.

28 Claims, 12 Drawing Sheets

(56) References Cited

U.S. PATENT DOCUMENTS

| | | | | |
|---|---|---|---|---|
| 6,767,075 | B1 | 7/2004 | Takada et al. | |
| 7,562,958 | B2 * | 7/2009 | Asauchi | 347/19 |
| 7,987,729 | B2 | 8/2011 | Sugahara | |
| 8,042,925 | B2 | 10/2011 | Sugahara et al. | |
| 8,939,561 | B2 * | 1/2015 | Kanbe et al. | 347/86 |
| 2009/0096848 | A1 | 4/2009 | Kanbe et al. | |
| 2009/0179925 | A1 | 7/2009 | Sugahara | |
| 2009/0179926 | A1 | 7/2009 | Sugahara | |
| 2009/0184991 | A1 | 7/2009 | Sugahara | |
| 2010/0245413 | A1 | 9/2010 | Kanbe et al. | |
| 2011/0310190 | A1 | 12/2011 | Kanbe et al. | |

FOREIGN PATENT DOCUMENTS

| | | | |
|---|---|---|---|
| CN | 101844452 | A | 9/2010 |
| CN | 102285232 | A | 12/2011 |
| EP | 1905594 | A1 | 4/2008 |
| JP | 2007-261051 | A | 10/2007 |
| JP | 2007-268793 | A | 10/2007 |
| JP | 2008-137218 | A | 6/2008 |
| JP | 2009-132098 | A | 6/2009 |

* cited by examiner

INK CONTAINING DEVICE AND INK SUPPLY DEVICE

CROSS-REFERENCE TO RELATED APPLICATION

This application is a continuation of U.S. patent application Ser. No. 13/843,518, filed on Mar. 15, 2013, which claims priority from Japanese Patent Application No. 2012-095698, filed on Apr. 19, 2012, the disclosures of which are incorporated herein by reference in their entirety.

BACKGROUND OF THE INVENTION

1. Field of the Invention

The invention relates generally to an ink containing device comprising an ink cartridge and an adapter, and an ink supply device.

2. Description of Related Art

A known image recording apparatus is configured to record an image on a recording sheet by using ink. The image recording apparatus includes an inkjet recording head that selectively ejects ink droplets from nozzles of the recording head onto a recording sheet. The ejected ink droplets land on the recording sheet to record a desired image on the recording sheet. The image recording apparatus includes an ink cartridge storing ink therein to supply ink to the recording head. The ink cartridge is configured to be removably mountable onto a cartridge mounting portion provided in the image recording apparatus.

The ink cartridge includes an ink remaining amount detecting portion to be used for inspecting a remaining amount of ink in the ink cartridge therethrough. The ink cartridge further includes a memory module and a light attenuating portion that is detectable by an optical sensor, to be used for determining one or more of ink color, ink material, a remaining amount of ink, and a maintenance condition of the ink cartridge. An electrical connection is established between the memory module and a contact disposed on the cartridge mounting portion while the ink cartridge is mounted in the cartridge mounting portion. In this state, data stored in the memory module is allowed to be read out. The light attenuating portion is configured to be detected by the optical sensor disposed in the cartridge mounting portion. A known adapter is configured to be removably attachable to the ink cartridge.

SUMMARY OF THE INVENTION

When the ink cartridge is depleted of ink from image recording, the ink cartridge may be replaced. Changes to the ink remaining amount detecting portion may be used to determine whether the ink cartridge is depleted. As the depleted ink cartridge is removed and replaced with a new ink cartridge, the presence of ink may be detected through the ink remaining amount detecting portion of the new ink cartridge.

The ink cartridge may be replaced with the adapter still attached to the cartridge mounting portion. The data stored in the memory module and the light attenuating portion of the adapter may not be updated to reflect the newly replaced ink cartridge.

The invention may provide for a technique for reliably detecting replacement of a ink cartridge while an adapter remains in a cartridge mounting portion.

According to an embodiment of the invention, an ink containing device comprising: an ink cartridge comprising: a first main body comprising a first surface facing a first direction and a chamber configured to store ink; an ink outlet portion disposed on the first surface of the first main body and configured to direct the ink from the chamber to an exterior of the first main body; and an ink detecting portion configured to detect the ink stored in the chamber; and an adapter configured to attach to the ink cartridge, the adapter comprising a second main body; and a movable member configured to move with respect to the second main body; wherein the movable member is configured to move between a first position and a second position, wherein the movable member is in the first position when the ink cartridge detaches from the adapter, and wherein, when the adapter attaches to the ink cartridge, the movable member is configured to move in the first direction from the first position to the second position, which is downstream from the first surface in the first direction.

According to another embodiment of the invention, an adapter, comprising: a main body comprising a particular surface facing a particular direction; and an electrical interface disposed on the particular surface; a further surface facing a further direction intersecting the particular direction; and, a movable member configured to move with respect to the main body along the further direction; wherein the further surface has a first opening, and the movable member is configured to move through the first opening.

Other objects, features, and advantages will be apparent to persons of ordinary skill in the art from the following detailed description of the disclosure and the accompanying drawings.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION OF EMBODIMENT

Figure 1:
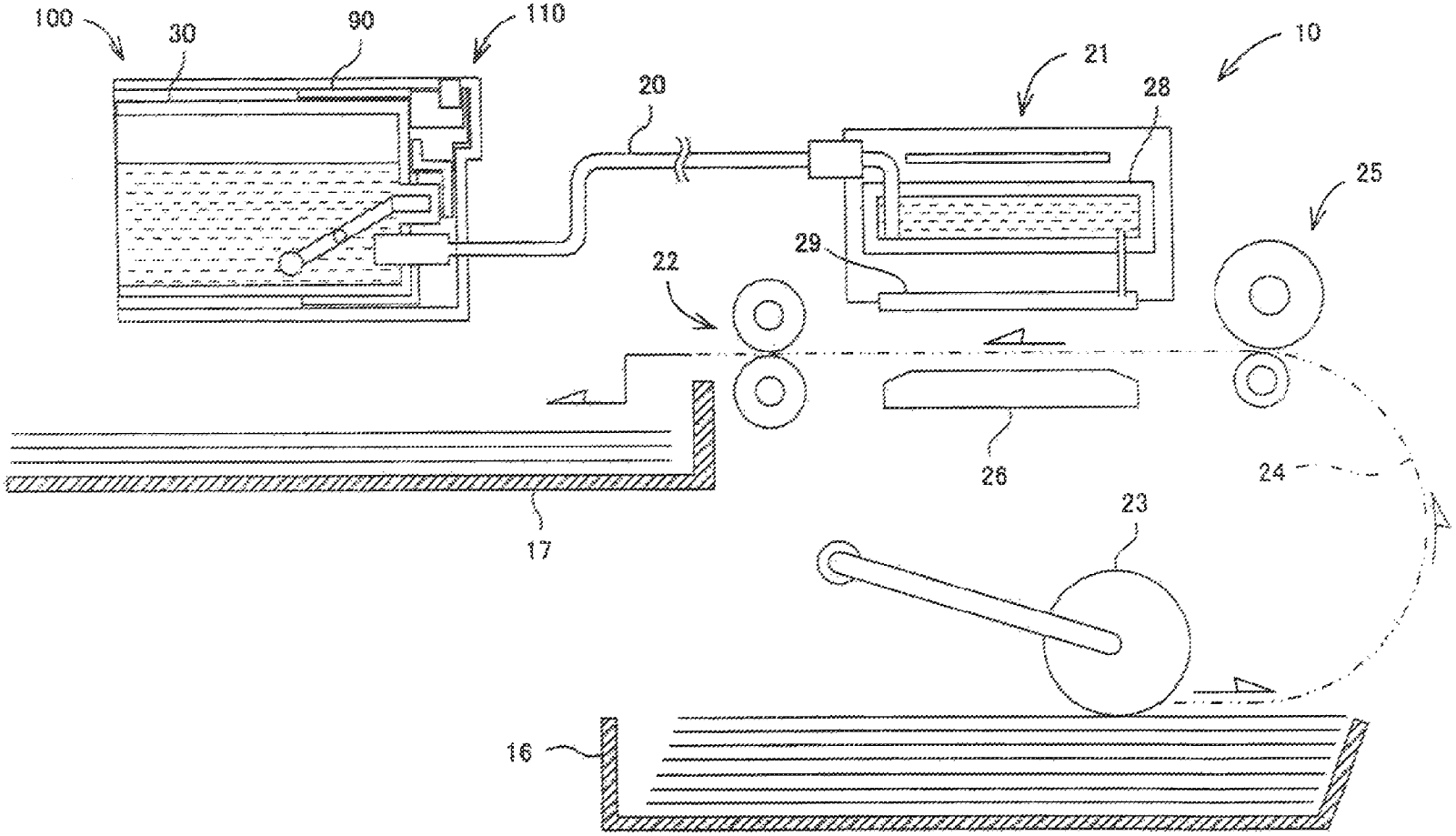
FIG. 1 is a schematic view of an internal configuration of a printer according to an embodiment of the invention.

Example embodiments are described in detail herein with reference to the accompanying drawings, like reference numerals being used for like corresponding parts in the various drawings.

Referring to FIG. 1, a printer 10 may be configured to record an image on a recording sheet by selectively ejecting ink droplets onto the recording sheet using an inkjet recording system. The printer 10 may comprise a recording head 21 and an ink supply device 100. The ink supply device 100 may comprise a cartridge mounting portion 110. The cartridge mounting portion 110 may be configured to receive an ink cartridge 30 and an adapter 90. The cartridge mounting portion 110 may have an opening 112 open to an exterior of the cartridge mounting portion 110. One or both of the ink cartridge 30 and the adapter 90 may be inserted into or removed selectively from the cartridge mounting portion 110 via the opening 112. The ink cartridge 30 and the adapter 90 may correspond to a ink containing device.

The ink cartridge 30 may be configured to store ink to be used in the printer 10. When the ink cartridge 30 is mounted to the cartridge mounting portion 110, the ink cartridge 30 and the recording head 21 may be connected to each other via an ink tube 20. The recording head 21 may comprise a sub-tank 28. The sub-tank 28 may be configured to temporarily store ink supplied from the ink cartridge 30 via the ink tube 20. The recording head 21 may be configured to selectively eject ink from the nozzles 29.

In the printer 10, a feed roller 23 may feed recording sheets one by one from a sheet feed tray 16 to a conveying path 24. A conveyor roller pair 25 may further convey the recording sheet onto a platen 26. The recording head 21 may be configured to selectively eject ink onto the recording sheet that is passing over the platen 26 to record an image on the recording sheet. A discharge roller pair 22 then may discharge the recording sheet, which has passed over the platen 26, onto a sheet discharge tray 17 disposed at a downstream end of the conveying path 24.

Figure 2:
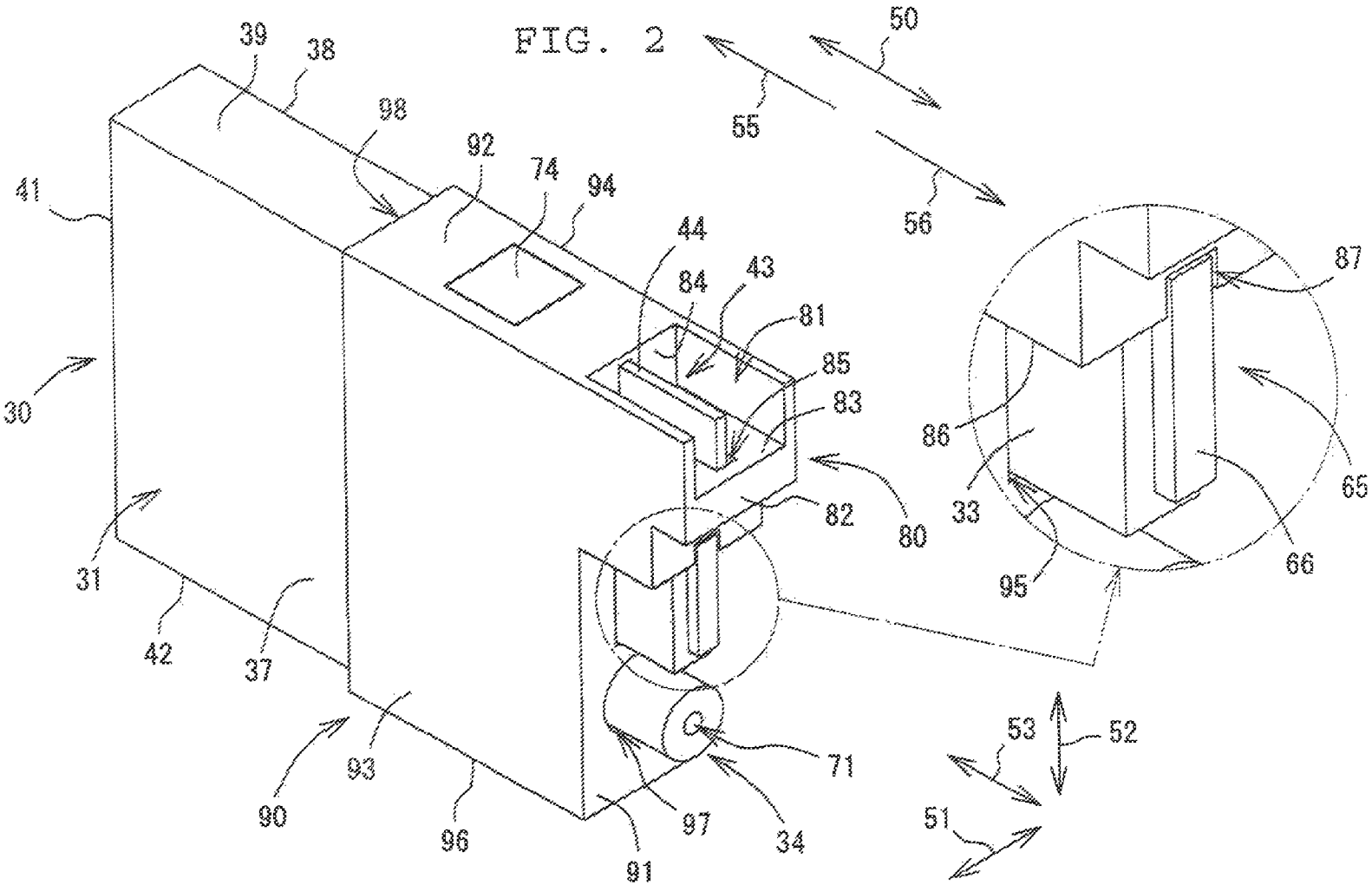
FIG. 2 is a perspective view of an ink cartridge, to which an adapter attaches, according to an embodiment of the invention.
Figure 3:
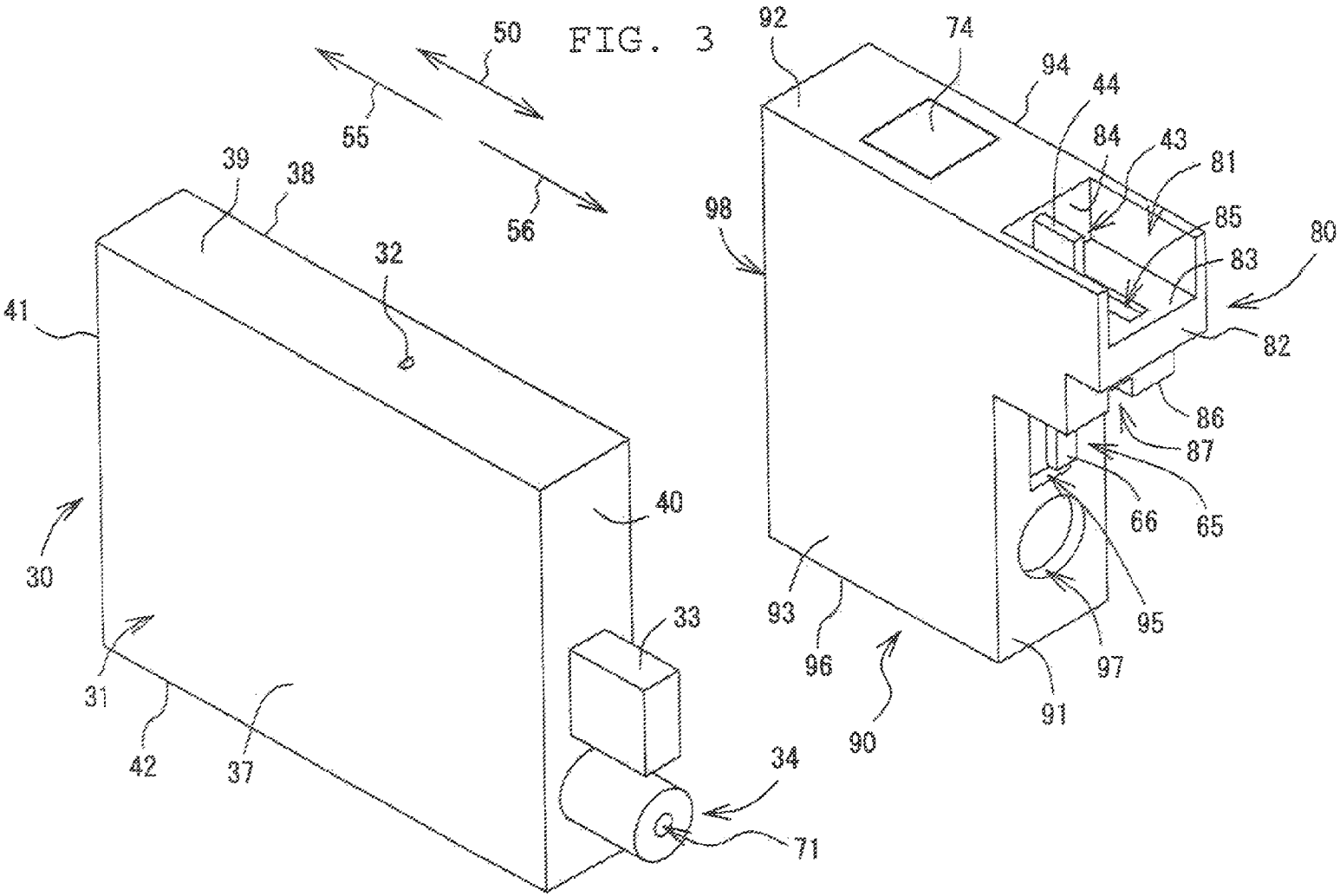
FIG. 3 is a perspective view of the ink cartridge and the adapter of FIG. 2.
Figure 4:
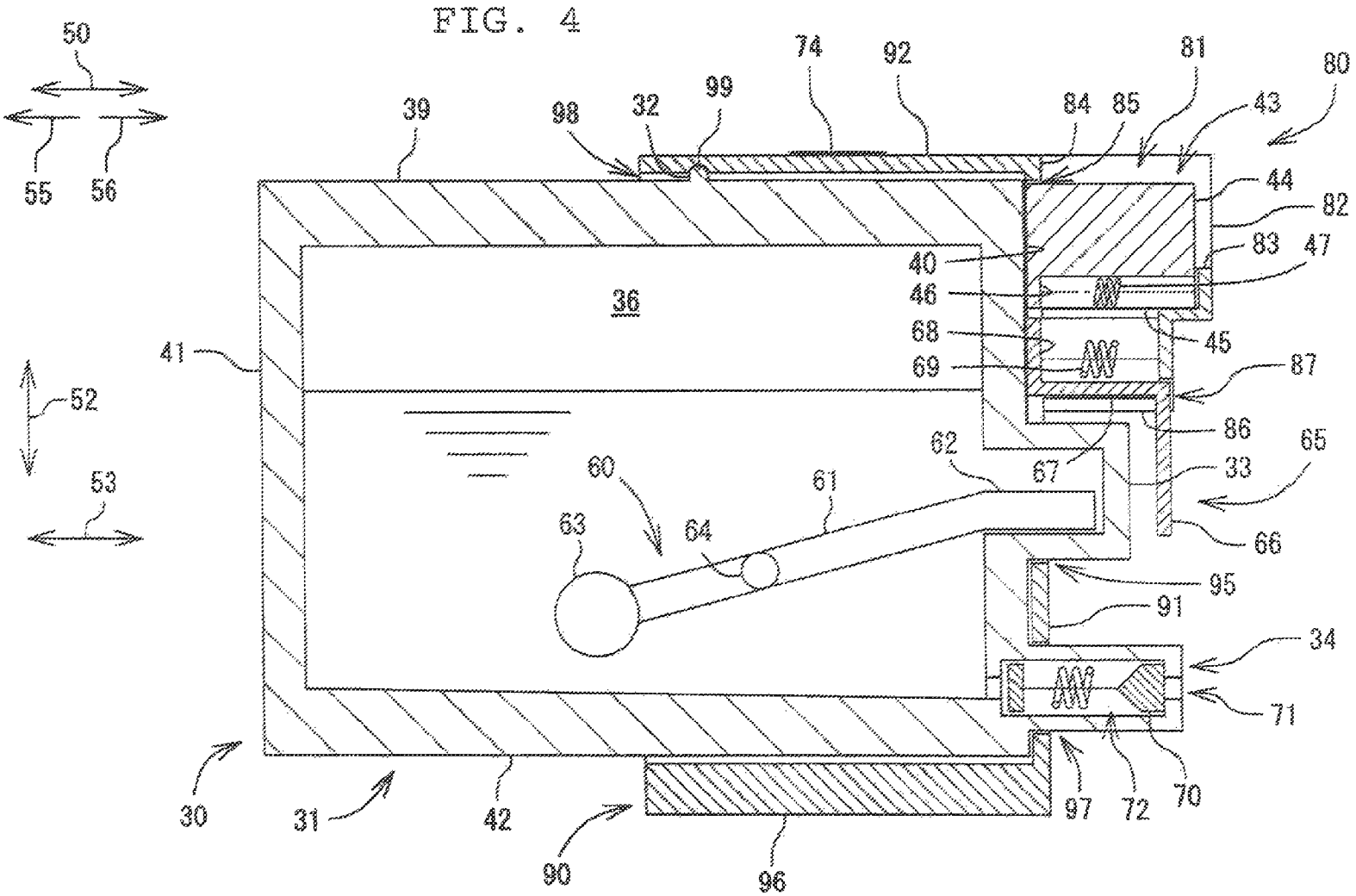
FIG. 4 is a cross-sectional view of an ink cartridge, to which an adapter attaches, according to an embodiment of the invention.

Referring to FIGS. 2-4, the ink cartridge 30 may be a container configured to store ink therein and may comprise a main body 31. The ink cartridge 30 may have a space formed therein that may serve as an ink chamber 36, as shown in FIG. 4, for storing ink. The ink chamber 36 may be defined by and contained within the main body 31 defining the external shape of the ink cartridge 30.

Referring to FIG. 2, the ink cartridge 30 may be inserted into or removed from the cartridge mounting portion 110 in an insertion and removal direction 50 in the cartridge standing orientation. The insertion and removal direction 50 may extend along a horizontal direction. The ink cartridge 30 may be inserted into or removed from the cartridge mounting portion 110 in the cartridge standing orientation. The cartridge standing orientation may correspond to a cartridge mounting orientation. The ink cartridge 30 may be inserted into the cartridge mounting portion 110 in an insertion direction 56. The ink cartridge 30 may be removed from the cartridge mounting portion 110 in a removal direction 55. A height direction 52, e.g., top-bottom direction, of ink cartridge 30 in the cartridge standing orientation may be parallel to a direction of gravity. The ink cartridge 30 may be inserted into or removed from the cartridge mounting portion 110 along the insertion and removal direction 50. The insertion and removal direction 50 may extend along the horizontal direction. In another embodiment, the insertion and removal direction 50 may be parallel to the direction of gravity or intersect the horizontal direction or the direction of gravity. For example, when the insertion and removal direction 50 is parallel to the gravity direction, a front surface of the ink cartridge 30 in the insertion direction 56 may face downward during the insertion and removal of the ink cartridge 30 to and from the cartridge mounting portion 110.

Referring to FIGS. 2-4, the ink cartridge 30 may comprise the main body 31. The main body 31 may have a three-dimensional shape having flat or curved surfaces, e.g., substantially a rectangular parallelepiped shape. The main body 31 may have a relatively thin body in which a dimension in the height direction e.g., top-bottom direction, and a dimension in a depth direction 53, e.g., front-rear direction, may be greater than a dimension in a width direction 51, e.g., right-left direction. The main body 31 may be defined by a front wall 40, a rear wall 41, a pair of side walls 37 and 38, an upper wall 39, and a lower wall 42. The ink cartridge 30 may be configured such that an adapter 90 may be removably attached to the main body 31 from a side of the front wall 40. An outer surface of the front wall 40 of the main body 31 may correspond to a first surface. An outer surface of the rear wall 41 of the main body 31 may correspond to a rear surface.

Referring to FIGS. 2-4, when the ink cartridge 30 is inserted into the cartridge mounting portion 110, the front wall 40 of the main body 31 may face forward with respect to the insertion direction 56, e.g., a first direction, and the rear wall 41 of the main body 31 may face rearward with respect to the insertion direction 56. In the ink cartridge 30, the front wall. 40 and the rear wall 41 may be disposed opposite to each other in the depth direction 53. The side walls 37, 38 may extend between the front wall 40 and the rear wall 41 in the depth direction 53. The upper wall 39 may extend between and connect upper ends of the side walls 37 and 38, the front wall 40 and the rear wall 41 to each other along the depth direction 53. The lower wall 42 may extend between and connect lower ends of the side walls 37 and 38, the front wall 40 and the rear wall 41 to each other along the depth direction 53. The insertion and removal direction 50 may be parallel to the depth direction 53 when the ink cartridge 30 is mounted to the cartridge mounting portion 110.

Figure 5:
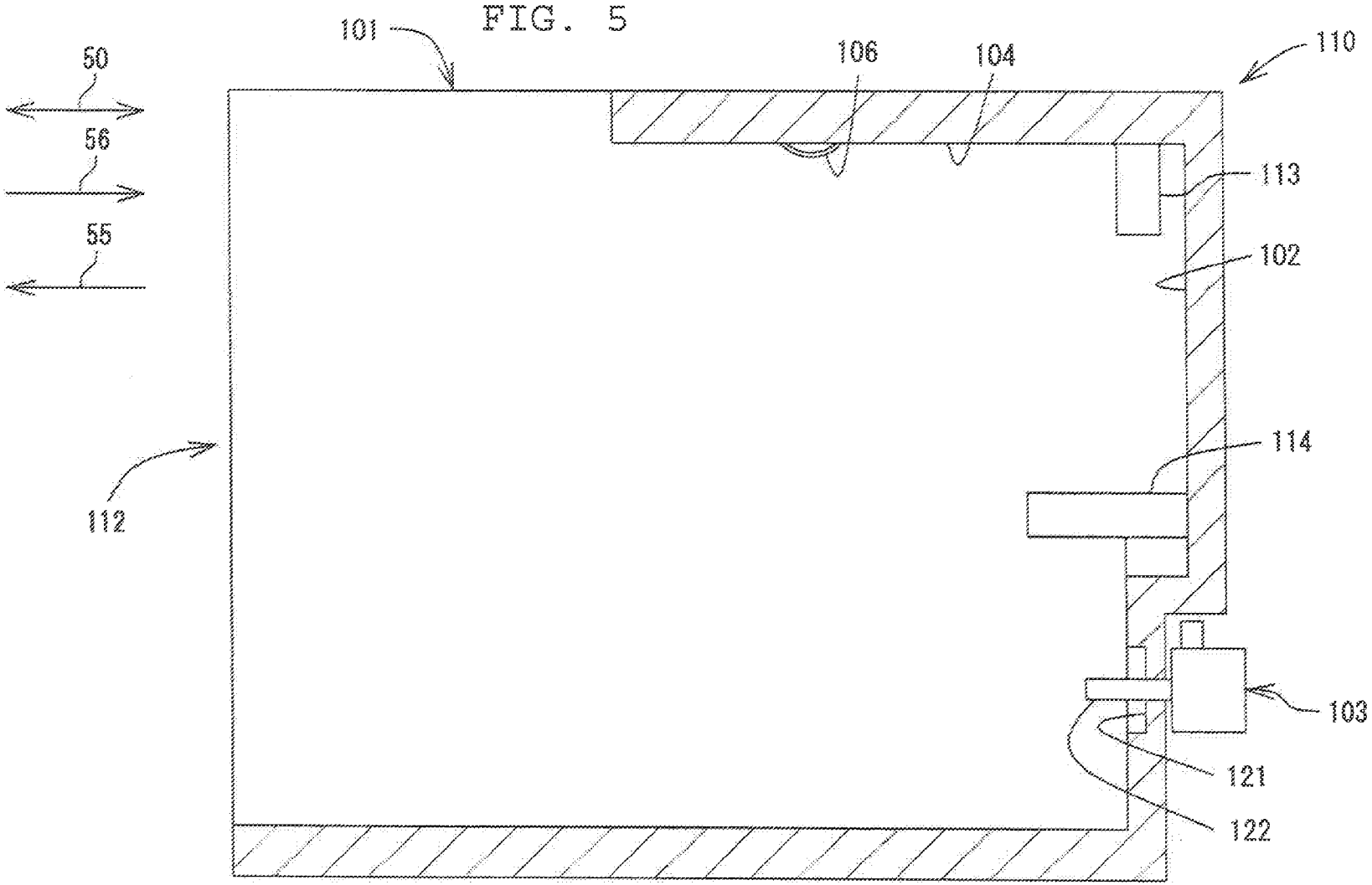
FIG. 5 is a cross-sectional view of a cartridge mounting portion according to an embodiment of the invention.

Referring to FIGS. 2-4, an ink remaining amount detecting portion 33 may be disposed at a substantially middle portion of the front wall 40 of the main body 31 in the height direction 52. The ink remaining amount detecting portion 33 may have an open-box shape with an open end. The ink remaining amount detecting portion 33 may be configured to be in fluid communication with the ink chamber 36 via the open end. The ink remaining amount detecting portion 33 may comprise a pair of right and left walls comprising translucent, e.g., transparent or semi-transparent, resin. The pair of right and left walls may allow light, e.g., infrared light, which is emitted from an optical sensor 114 as depicted in FIG. 5, in a direction perpendicular to the insertion and removal direction 50, e.g., the width direction 51, to pass through. The ink remaining amount detecting portion 33 may be exposed to an exterior of the ink, cartridge 30 via an opening 95 formed in the adapter 90. In another embodiment, the ink remaining amount detecting portion 33 may comprise a reflecting member configured to reflect light incident on a translucent resin material at an angel more than a critical angle. Further, the light emitted from the optical sensor 114 may be one of infrared light and visible light.

The right and left walls of the ink remaining amount detecting portion 33 may be separated from each other to store ink therebetween in the ink remaining amount detecting portion 33. Referring to FIG. 4, a sensor arm 60, e.g., a ink detecting portion, may comprise a plate-shaped arm body 61, an indicator 62, and a float 63. The indicator 62 and the float 63 may be disposed at respective ends of the arm body 61. The indicator 62 may be positioned between the right and left walls of the ink remaining amount detecting portion 33. The sensor arm. 60 may be pivotally supported by a support shaft 64 extending along the width direction 51 in the ink chamber 36. The sensor arm 60 may be configured to pivot in accordance with an amount of ink presenting in the ink chamber 36. The sensor arm 60 may be configured to move according to the remaining amount of ink in the ink chamber 36, between a lower position in which the indicator 62 may be located in a lower position in the direction of gravity in the ink remaining amount detecting portion 33 and an upper position in which the indicator 62 may be located in an upper position in the direction of gravity in the ink remaining amount detecting portion 33. The upper position of the indicator 62 may be higher than the lower position of the indicator 62. Referring to FIG. 4, a predetermined amount or more of ink is present in the ink chamber 36 and the indicator 62 is located in the lower position.

The optical sensor 114 may be disposed in the cartridge mounting portion 110. While the ink cartridge 30 is mounted to the cartridge mounting portion 110, the ink remaining amount detecting portion 33 may also change its state according to the remaining amount of ink in the ink chamber 36. More specifically, in one state, the ink remaining amount detecting portion 33 may allow a predetermined amount or more of the infrared light, which is emitted from the optical sensor 114 in a direction perpendicular to the insertion and removal direction 50, e.g., the width direction 51, to pass through in the other state, the ink remaining amount detecting portion 33 may block or attenuate the infrared light to an amount less than the predetermined amount. When the indicator 62 is located in the upper position, the ink remaining amount detecting portion 33 may allow the infrared light to pass therethrough. When the indicator 62 is located in the lower position, the ink remaining amount detecting portion 33 may block or attenuate the infrared light. Based on whether the ink remaining amount detecting portion 33 allows that infrared light to pass therethrough or block or attenuate the infrared light, the ink remaining amount in the ink chamber 36 may be determined.

In another embodiment, the ink remaining amount detecting portion 33 may not comprise the sensor arm 60. In this case, the optical sensor 114 may comprise a light-emitting element and a light-receiving element that may be disposed opposite to each other in a horizontal direction perpendicular to the insertion and removal direction 50. The horizontal direction may correspond to the width direction, e.g., the right-left direction 51, of the ink cartridge 30 when the ink cartridge 30 is mounted in the cartridge mounting portion 110. The light emitted from the light-emitting element may travel in the horizontal direction perpendicular to the insertion and removal direction 50 and be received by the light-receiving element. When ink is present in the ink remaining amount detecting portion 33, the ink remaining amount detecting portion 33 may block or attenuate the infrared light emitted from the light-emitting element. When ink is not present in the ink remaining amount detecting portion 33, the ink remaining amount detecting portion 33 may allow a predetermined amount or more the light emitted from the light-emitting element to pass through. Further, the ink remaining amount detecting portion 33 may comprise a flexible film and a pivot lever. When ink is present in the ink remaining amount detecting portion 33, the film may be expanded. Under this condition, the lever may be configured to contact the film and be maintained at a position to block the infrared light. When ink is not present in the ink remaining amount detecting portion 33, the film may be contracted. Under this condition, the lever may be configured to pivot upward or downward to a position, in which the lever does not block the infrared light. The ink remaining amount detecting portion 33 may be configured to reflect the infrared light emitted from the light-emitting element of the optical sensor 114, such that the infrared light does not reach the light-receiving element when ink is present in the ink remaining amount detecting portion 33, and reflect the infrared light to reach the light-receiving element when ink is not present in the ink remaining amount detecting portion 33. The ink remaining amount detection portion 33 and the sensor arm. 60 may correspond to an ink amount detection portion.

The main body 31 may comprise an ink outlet portion 34 disposed at the front wall 40 and below the ink remaining amount detecting portion 33. The ink outlet portion 34 may be cylindrical in its outer shape and may protrude outward from the front wall 40 in the depth direction 53. A protruding end of the ink outlet portion 34 may have an ink outlet port 71. The ink outlet port 71 of the ink outlet portion 34 may be exposed to an exterior of the adapter 90 through an opening 97 of the adapter 90 when the ink cartridge 30 attaches to the adapter 90. The opening 95 is formed in a center area in upper direction of the front wall 91, and the opening 97 is formed upstream from the opening 95 upper direction.

Referring to FIG. 4, the ink outlet portion 34 may have an ink channel 72 formed therein. The ink channel 72 may extend from the ink outlet port 71 to the ink chamber 36 via an internal space of the ink outlet portion 34 along the depth direction 53 and may place the ink chamber 36 in fluid communication with the ink outlet portion 71. An ink outlet valve 70 may be disposed in the ink channel 72 and configured to selectively open and close the ink outlet port 71. When the ink cartridge 30 is mounted to the cartridge mounting portion 110, a hollow tube 122, as depicted in FIG. 5, of the cartridge mounting portion 110 may enter the ink outlet port 71 to open the ink outlet valve 70. Thus, ink may flow from the ink chamber 36 into the hollow tube 122 of the cartridge mounting portion 110 through the ink channel 72.

In another embodiment the ink outlet port 71 may be sealed with a film. When the ink cartridge 30 is mounted to the cartridge mounting portion 110, the hollow tube 122 may penetrate the film to open the ink outlet port 71. In another embodiment, the main body 31 may comprise an atmosphere communication port for bringing the negative pressure in the ink chamber 36 to the atmospheric pressure.

The main body 31 may further comprise a protrusion 32 on the upper wall 39. The protrusion 32 may protrude upward from the upper wall 39 at a position that may be covered by the adapter 90. The protrusion 32 may be configured to be engaged in a recess 99 of the adapter 90. When the ink cartridge 30 attaches to the adapter 90, this configuration may maintain the engagement of the ink cartridge 30 and the adapter 90 against urging force of coil springs 47 and 69 of the adapter 90 while the front wall 40 of the main body 31 and the front wall 91 of the adapter 90 are in a close proximity state.

The adapter 90 may comprise a main body and a projecting portion 80. The main body of the adapter 90 may have a relatively thin box-shape with an open end and be configured to cover at least a portion of outer surfaces of the main body 31, e.g., portions of the front wall 40, the side walls 37 and 38, the upper wall 39, and the lower wall 42. The adapter 90 may have a width and height to cover a whole area of the front wall 40 of the main body 31 and a depth to cover portions of the side walls 37 and 38, the upper wall 39, and the lower wall 42. The adapter 90 may have a box shape having a width and height slightly greater than the width and height of the main body 31 and a depth less than the depth of the main body 31.

The adapter 90 may comprise a front wall 91, an upper wall 92 a facing upper direction of the height direction 52, side walls 93 and 94, and a lower wall 96. When the adapter 90 attaches to the ink cartridge 30, the front wall 91 may face forward and the front wall 40 of the main body 31, the upper wall 92 may face the upper wall 39 of the main body 31, the side walls 93 and 94 may face the side walls 37 and 38 of the main body 31, respectively, and the lower wall 96 may face the lower wall 42 of the main body 31. The upper wall 92 may be intersecting to the front wall 91. For more details, the upper wall 92 may be perpendicular to the front wall 91. The adapter 90 may have an opening 98 in a side opposite to the front wall 91 in the depth direction 53. The adapter 90 may allow the main body 31 of the ink cartridge 30 to be inserted therein via the opening 98. An outer surface of the front wall 91 may correspond to a front surface of the adapter 90. In other embodiments, the front wall 91 may be sloped with respect to the upper wall 92.

An orientation of the adapter 90, as depicted in FIGS. 2-4, may be referred to as an "adapter standing orientation." The adapter 90 may be inserted into or removed from the cartridge mounting portion 110 in the direction indicated by the double-headed arrow 50 in the adapter standing orientation, as depicted in FIG. 2. The adapter 90 may be inserted into or removed from the cartridge mounting portion 110 while maintained in the adapter standing orientation. The adapter standing orientation may correspond to an adapter adapting orientation.

The adapter 90 may have the opening 95 formed through the front wall 91 in the depth direction 53 at substantially a middle portion of the front wall 91 in the height direction 52. When the main body 31 of the ink cartridge 30 is inserted into the adapter 90, the ink remaining amount detecting portion 33 of the main body 31 may be exposed to the exterior of the adapter 90 through the opening 95. That is, the position, size, and shape of the opening 95 may correspond to the position, size, and shape of the ink remaining amount detecting portion 33.

The adapter 90 may have the opening 97 formed through the front wall 91 in the depth direction 53 at a lower portion of the front wall 91 in the height direction 52. When the main body 31 of the ink cartridge 30 is inserted into and adapted to the adapter 90, the ink outlet portion 34 of the main body 31 may be exposed to the exterior of the adapter 90 through the opening 97. That is, the position, size, and shape of the opening 97 may correspond to the position, size, and shape of the ink outlet portion 34.

The adapter 90 may further comprise an IC substrate 74 disposed on the upper wall 92 and behind a light attenuating portion 43 in the depth direction 53. The ink remaining amount detecting portion 33 is disposed downstream from the ink outlet portion 34 in the second direction and IC substrate 74 is disposed downstream from the ink remaining amount detecting portion 33 in the second direction when the ink cartridge 30 attaches to the adapter 90. An electrical connection may be established between the IC substrate 74 and a contact 106, as depicted in FIG. 5, of the cartridge mounting portion 110 during the mounting of the adapter 90 to the cartridge mounting portion 110. The electric connection may be maintained while the adapter 90 is mounted in the cartridge mounting portion 110. The IC substrate 74 may correspond to an electrical interface.

The IC substrate 74 may comprise an integrated circuit ("IC"), a HOT electrode, a GND electrode, and a signal electrode. The IC may be a semiconductor integrated circuit and may be configured to store data indicating information about the ink cartridge 30, e.g., one or more of a lot number, a date of manufacture, and ink color. The data stored in the IC may be read out by the printer 10.

The HOT electrode, the GND electrode, and the signal electrode may be electrically connected with the IC. The HOT electrode, the GND electrode, and the signal electrode may be elongated along the depth direction 53 and may be separated from each other in the width direction 51. The HOT electrode, the GM) electrode, and the signal electrode may be exposed at an upper surface of the IC substrate 74 so as to be electrically accessible by the contact 106. That is, the HOT electrode, the GND electrode, and the signal electrode may be exposed to an exterior of the adapter 90 so as to be accessible by the contact 106 from above the adapter 90 in the adapter mounting orientation. A dimension in the depth direction 53 of the IC substrate 74 on which the HOT electrode, the GM) electrode, and the signal electrode may be greater than a dimension of the IC substrate 74 in the width direction 51.

Referring to FIGS. 2-4, the adapter 90 may comprise the projecting portion 80 at an upper part of the front wall 91 of the main body. The projecting portion 80 may protrude forward in the depth direction 53. The projecting portion 80 may have a recessed portion 81 in its upper surface. The recessed portion 81 may have a groove-like shape and extend along the depth direction 53 in substantially a middle part of the projecting portion 80 in the width direction 51. The recessed portion 81 may form an opening in a front end surface 82 of the projecting portion 80. The recessed portion 81 may have a slit 85 in a bottom surface 83 of the recessed portion 81 and a rear end surface 84 of the recessed portion 81. The slit 85 may extend along the height direction 52 in the rear end surface 84 and also extend along the depth direction 53 in the bottom surface 83. The slit 85 may correspond to a guide portion. In another embodiment, the projecting portion 80 may not comprise the walls standing on both sides of the slit 85 to define the recessed portion with respect to the width direction 51. The rear end surface 84 of the recessed portion 81 may be a part of the front wall 91 of the adapter 90.

The light attenuating portion 43, e.g., movable member, may be disposed inside the adapter 90 and configured to slide in the slit 85 along the depth direction 53. The light attenuating portion 43 may be supported by a base portion 45 e.g. main body. The light attenuating portion 43 may comprise a plate-shaped plate portion 44 and a base portion 45. The plate portion 44 may be inserted through the slit 85. The base portion 45 may be disposed inside the adapter 90 and extend along the depth direction 53. The plate portion 44 may protrude upward from the base portion 45 so as to be exposed to the exterior of the adapter 90 through the slit 85. An upper end of the plate portion 44 may be located lower than an upper end of the upper wall 92 and upper ends of the walls defining the recessed portion 81 in the height direction 52. The base portion 45 may comprise a spring seat 46 at its lower part and on a side near the opening 98 of the base portion 45. The coil spring 47 may be disposed between the spring seat 46 and a wall defining the front end surface 82 of the projecting portion 80. The coil spring 47 may be contracted with respect to the removal direction 55. The base portion 45 may be located at an end of a slidable range, e.g., a first position of the light attenuating portion 43 under the urging force of the coil spring 47 in the removal direction 55 when an external force is not applied to the base portion 45. An end of the slidable range may be located closer to the opening 98 than the other end of the slidable range. Under this condition, a front end of the plate portion 44 in the insertion direction 56 may be located at a position near the rear end surface 84 of the recessed portion 81. The coil spring 47 may correspond to a biasing member.

The base portion 45 may be configured to slide toward the front end surface 82 of the projecting portion 80 against the urging force of the coil spring 47 by which the front wall 40 of the main body 31 may contact the base portion 45 and the main body 31 may be further inserted into the adapter 90. In this state, the front end of the plate portion 44 in the insertion direction 56 may be located at a position near the front end surface 82 of the recessed portion 81. The plate portion 44 may be configured to attenuate or block, for example, infrared light, that may be emitted from an optical sensor 113 and travel in the direction, e.g., the width direction 51, perpendicular to the insertion and removal direction 50. The light attenuating portion 43 may correspond to a first light attenuating portion.

Referring to FIGS. 2-4, the projecting portion 80 of the adapter 90 may have a slit 87 extending along the depth direction 53 in a lower surface 86 of the projecting portion 80. The slit 87 may correspond to the guide portion.

A light attenuating portion 65, e.g., further movable member, may be disposed inside the adapter 90 and below the light attenuating portion 43. The light attenuating portion 65 may be configured to slide along the depth direction 53. The light attenuating portion 65 may comprise a plate portion 66 and a base portion 67. The light attenuating portion 65 may be supported by a base portion 45 The plate portion 66 may be inserted in the slit 87. The base portion 67 may be disposed inside the adapter 90. The plate portion 66 may protrude downward from a lower surface of the base portion 67 on a front-end side. A lower end of the plate portion 66 may extend to a position at the same level as the position of the indicator 62 when viewed from the front of the plate portion 66. The base portion 67 may comprise a spring seat 68 at its upper surface and on a side located near the opening 98 of the base portion 67. The coil spring 69 may be disposed between the spring seat 68 and the wall defining the front end surface 82 of the projecting portion 80. The coil spring 69 may be contracted with respect to the removal direction 55. An end of the base portion 67 in the removal direction 55 may be a flat surface facing the front wall 40 of the ink cartridge 30. The base portion 67 may be located at an end of a slidable range of the light attenuating portion 65 under the urging force of the coil spring 69 in the removal direction 55 when an external force is not applied to the base portion 67. An end of the slidable range may be located closer to the opening 98 than the other end of the slidable range. Under this condition, a front end of the plate portion 66 in the insertion direction 56 may be located at a position near the front wall 9, e.g. first wall. The coil spring 69 may correspond to a biasing member.

The base portion 67 may slide toward the front end surface 82 of the projecting portion 80 against the urging force of the coil spring 69 by which the front wall 40 of the main body 31 of the ink cartridge 30 may contact the base portion 67 and the main body 31 may be further inserted into the adapter 90. In this state, the front end of the plate portion 66 in the insertion direction 56 may be located at a position near the front end surface 82 of the recessed portion 81 and behind the front end of the plate portion 44 of the light attenuating portion 43 in the insertion direction 56. Further, in this state, the plate portion 66 and the ink remaining amount detecting portion 33 may be separated from each other in the depth direction 53. The plate portion 66 may be configured to attenuate or block infrared light that may be emitted from the optical sensor 114 and traveling in the width direction 51 perpendicular to the insertion and removal direction 50. The light attenuating portion 65 may correspond to a second light attenuating portion.

Referring to FIG. 4, the adapter 90 may comprise the recess 99 in an inner surface of the upper wall 92. The recess 99 may engage the protrusion 32 of the main body 31 of the ink cartridge 30. The recess 99 may be disposed at a position to engage the protrusion 32 while the front wall 40 of the main body 31 of the ink cartridge 30 is located closer to the front wall 91 of the adapter 90 and the ink remaining amount detecting portion 33 and the ink outlet portion 34 protrude via the respective openings 95 and 97 of the adapter 90.

Referring to FIG. 1, the printer 10 may comprise the recording head 21 and the ink supply device 100. The ink supply device 100 may be configured to supply ink to the recording head 21. The ink, supply device 100 may comprise the cartridge mounting portion 110 configured to receive the ink cartridge 30 and the adapter 90 mounted thereto. The ink cartridge 30 and the adapter 90 may be mounted in the cartridge mounting portion 110, as depicted in FIG. 1. A height direction of the cartridge mounting portion 110 when the printer 10 is horizontally oriented may correspond to the direction of gravity and the height direction 52 of the ink cartridge 30.

Referring to FIG. 5, the cartridge mounting portion 110 may comprise a case 101 serving as a housing. The case 101 may have an opening 112 in the front side of the printer 10. The ink cartridge 30 and the adapter 90 may be inserted into or removed from the case 101 via the opening 112. The case 101 may be configured to accommodate a plurality of e.g., four, ink cartridges 30 of a plurality of colors, e.g., cyan, magenta, yellow, and black, respectively, and a plurality of, e.g., four, adapters 90 corresponding to the ink cartridges 30. A space of the case 101 for one ink cartridge 30 and a corresponding adapter 90 is depicted in FIG. 5.

Referring to FIG. 5, the case 101 may have a side inner surface 102 at a side opposite from the opening 112 in the insertion and removal direction 50. Connectors 103 may be disposed at a lower part of the side inner surface 102 of the case 101. The connectors 103 may be disposed at the side inner surface 102 at respective positions that may correspond to the ink outlet portions 43 of the respective ink cartridges 30 placed in the case 101.

Each connector 103 may comprise the hollow tube 122 and a holding portion 121. The hollow tube 122 may be a hollow needle made of resin. Each of the hollow tubes 122 may be connected with its respective ink tube 20 at an outer surface opposite from the side inner surface 102 of the case 101. Each of the ink tubes 20 drawn from its respective hollow tube 122 to the outer surface opposite from the side inner surface 102 of the case 101 may be routed upward along the outer surface of the case 101 and further extended to the recording head 21 of the printer 10 to allow ink to flow into the recording head 21.

Figure 6:
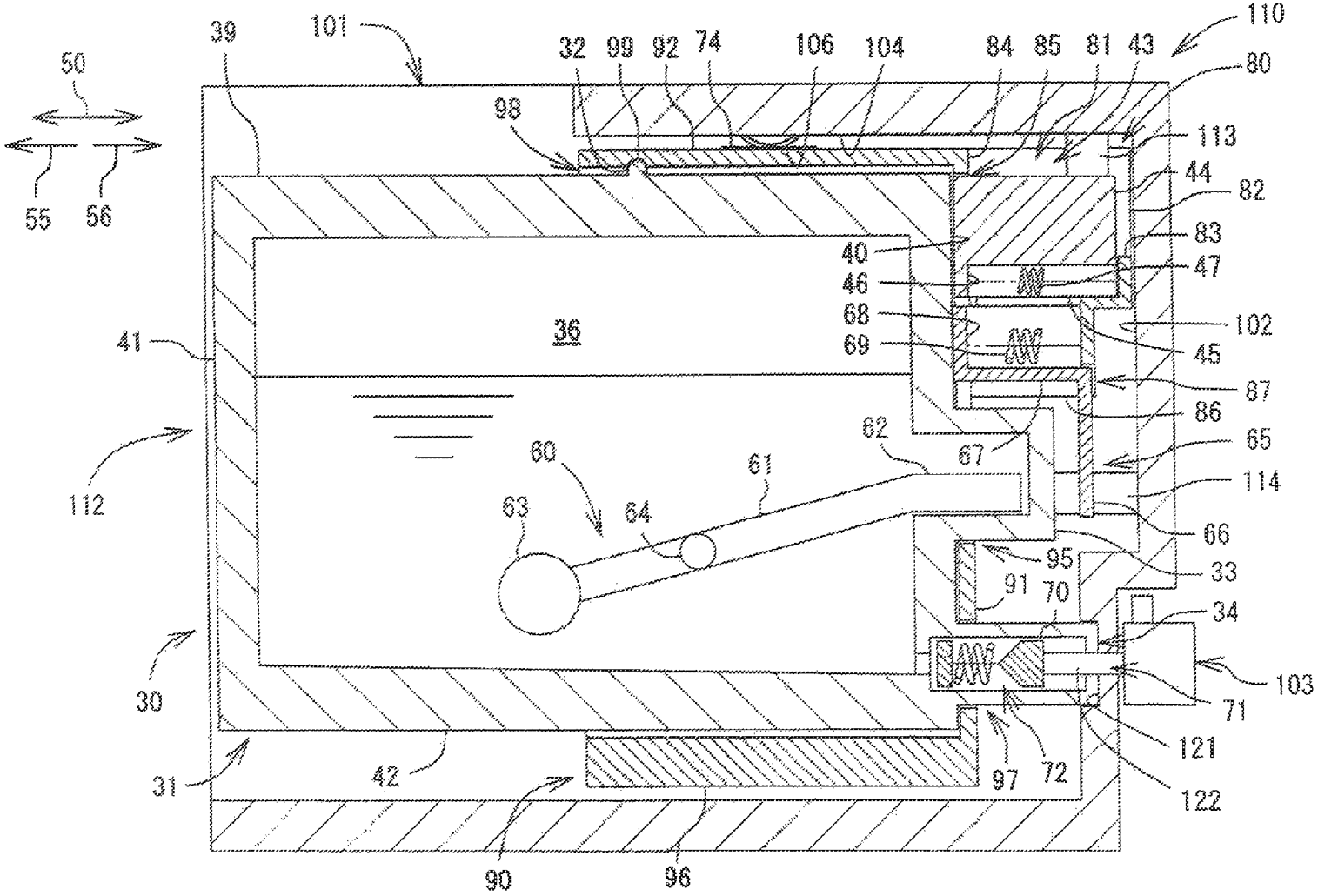
FIG. 6 is a cross-sectional view of a cartridge mounting portion, an ink cartridge mounted in the cartridge mounting portion, and an adapter attached to the ink cartridge according to an embodiment of the invention.

Each holding portion 121 may have a cylindrical shape. The hollow tube 122 may be disposed at substantially a center of the holding portion 121. Referring to FIG. 6, when the ink cartridge 30 is mounted to the cartridge mounting portion 110, the ink outlet portion 34 may be inserted into a cylindrical portion of the holding portion 121. An outer peripheral surface of the ink outlet portion 34 may tightly contact an inner peripheral surface of the cylindrical portion of the holding portion 121. Accordingly, the ink outlet portion 34 may be inserted into the holding portion 121 with a predetermined gap therebetween. When the ink outlet portion 34 is inserted into the holding portion 121, the hollow tube 122 may be inserted into the ink outlet port 71 of the ink outlet portion 34.

Thus, ink stored in the ink chamber 36 may flow to the outside of the ink cartridge 30. The ink flowing from the ink chamber 36 may flow into the hollow tube 122.

Referring to FIG. 5, the optical sensor 113 may be disposed on an upper inner surface 104 of the case 101 at a position closer to the side inner surface 102. The optical sensor 113 may comprise a light-emitting element such as a light-emitting diode ("LED") and a light-receiving element such as a phototransistor. Each of the light-emitting element and the light-receiving element may be surrounded by a housing. The external shape of the optical sensor 113 defined by the housing may be a horseshoe shape. The light-emitting element may be configured to emit light from the housing in one direction, e.g., a horizontal direction or the width direction 51, perpendicular to the insertion and removal direction 50. The light-receiving element may be configured to receive the light emitted in the one direction to the housing of the light-receiving element. The light-emitting element and the light-receiving element may be disposed to face each other with a predetermined gap therebetween in the respective horseshoe-shaped housings in the horizontal direction, e.g., the width direction 51 perpendicular to the insertion and removal direction 50. The plate portion 44 of the light attenuating portion 43 may move into a space between the light-emitting element and the light-receiving element. When the plate portion 44 enters an optical path of the light emitted from the optical sensor 113, the optical sensor 113 may detect a change in a light transmission amount due to the entry of the plate portion 44 into the optical path. The light emitted from the light-emitting element of the optical sensor 113 may correspond to a first light.

Referring to FIG. 5, the optical sensor 114 may be disposed on the side inner surface 102 of the case 101 and above the connector 103. The optical sensor 114 may comprise a light-emitting element such as an LED and a light-receiving element such as a phototransistor. Each of the light-emitting element and the light-receiving element may be surrounded by a housing. The external shape of the optical sensor 114 defined by the housing may be a horseshoe shape. The light-emitting element may be configured to emit light from the housing in one direction, e.g., a horizontal direction or the width direction 51 perpendicular to the insertion and removal direction 50. The light-receiving element may be configured to receive the light emitted in the one direction to the housing of the light-receiving element. The light-emitting element and the light-receiving element may be disposed to face each other with a predetermined gap therebetween in the respective horseshoe-shaped housings in the horizontal direction, e.g., the width direction 51 perpendicular to the insertion and removal direction 50. The ink remaining amount detecting portion 33 of the ink cartridge 30 and the plate portion 66 of the light attenuating portion 65 of the adapter 90 may move into a space between the light-emitting element and the light-receiving element. When one of the ink remaining amount detecting portion 33 and the plate portion 66 enters an optical path of the light emitted from the optical sensor 113, the optical sensor 114 may detect a change in a light transmission amount due to the entry of one of the ink remaining amount detecting portion 33 and the plate portion 66 into the optical path. The light emitted from the light-emitting element of the optical sensor 114 may correspond to a second light.

Referring to FIG. 5, the case 101 may comprise a plurality of, e.g., three, contacts 106 on an upper inner surface 104 and at a position between the side inner surface 102 and the opening 112 in the insertion and removal direction 50. The contacts 106 may be separated from each other in a direction orthogonal to the insertion and removal direction 50. The contacts 106 also may be disposed so as to correspond to the HOT electrode, the GND electrode, and the signal electrode provided on the IC substrate 74 of the ink cartridge 30, respectively. Each contact 106 may comprise an elastic conductive member and configured to be elastically deformed upward in the height direction 52.

The contacts 106 may be electrically connected with a controller via an electric circuit. The controller may comprise, for example, a central-processing unit ("CPU"), a read-only memory ("ROM"), a random-access memory ("RAM") and may be configured as a control device of the printer 10. One of the contacts 106 may be used to apply voltage Vc to HOT electrode 82 by establishing electrical connection with the HOT electrode. Another of the contact 106 may be used to allow the GND electrode to establish a ground by establishing electrical connection with the GND electrode. The above contacts 106 may be used to supply power to the IC by establishing electrical connection with the HOT electrode and the GND electrode, respectively. The other of the contacts 106 may be used to access the data stored in the IC by establishing electrical connection with the signal electrode.

Figure 7:
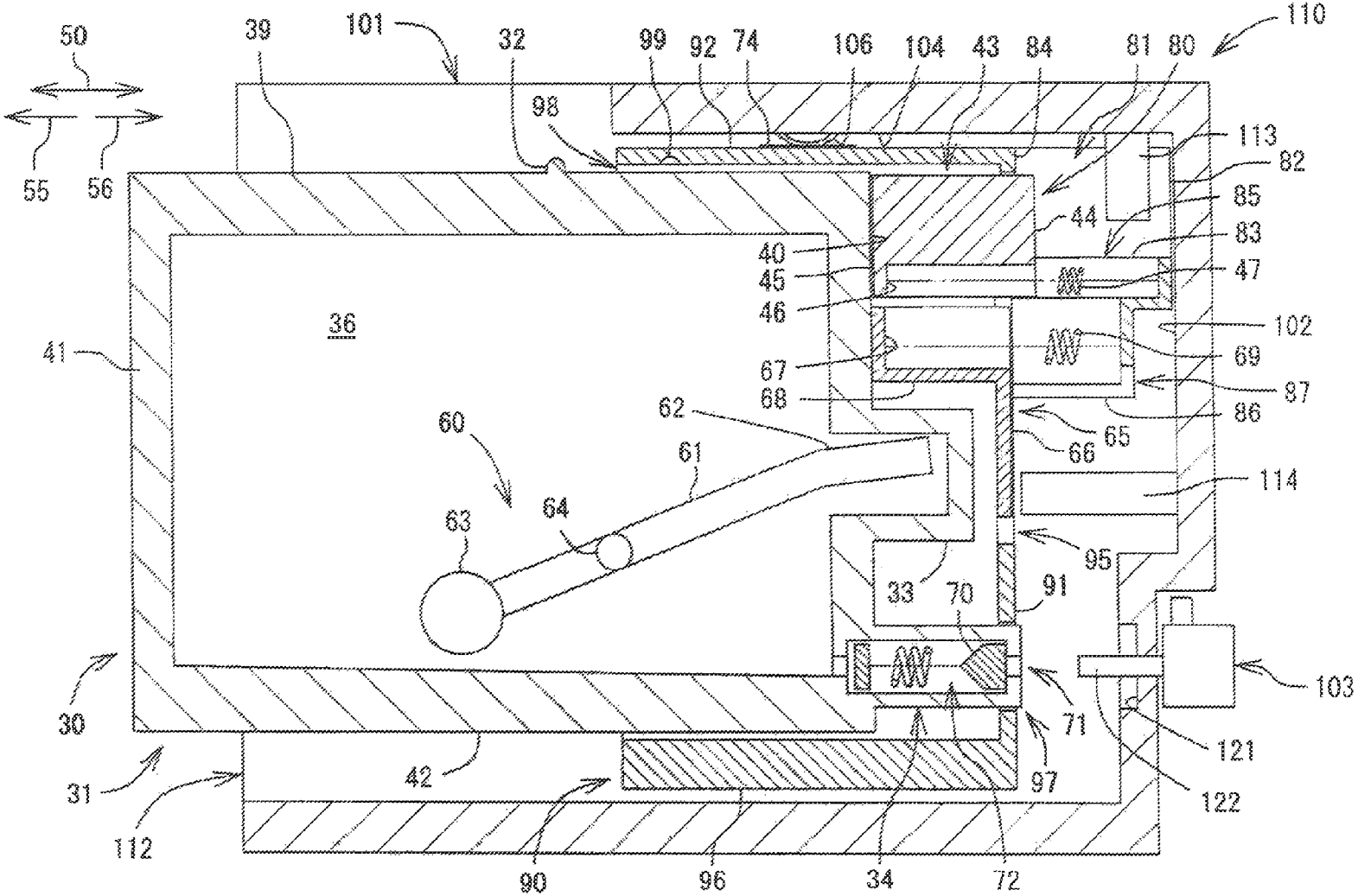
FIG. 7 is a cross-sectional view of the cartridge mounting portion, the ink cartridge, and the adapter of FIG. 6 in a process of removing the ink cartridge from the adapter according to an embodiment of the invention.

Referring to FIGS. 6 and 7, the ink cartridge 30 may be mounted onto the cartridge mounting portion 110 in a mounting operation. Before a user first uses the printer 10 after purchase, any one of the ink cartridges 30 and the adapters 90 may have not yet been mounted on the cartridge mounting portion 110 of the printer 10. Further, before the user first mounts the ink cartridges 30 having the respective adapters 90 to the cartridge mounting portion 110, the adapters 90 may have not yet been attached to the respective ink cartridges 30, either. In another words, the light attenuating portion is disposed in the first position when the ink cartridge is detached from the adapter.

Referring to FIG. 1, the adapter 90 may be attached to the main body 31 of the ink cartridge 30 from the side of the front wall 40 first, and then, the ink cartridge 30 having the adapter 90 may be inserted into the cartridge mounting portion 110. When the adapter 90 attaches to the ink cartridge 30, the ink outlet portion 34 and the ink remaining amount detecting portion 33 of the ink cartridge 30 may be exposed to the exterior of the adapter 90 via the openings 95 and 97, respectively. During the attachment of the adapter 90 to the ink cartridge 30, the light attenuating portions 43 and 65 of the adapter 90 may slide toward the front end surface 82 of the projecting portion 80 against the urging force of the coil springs 47 and 69, respectively, by which the front wall 40 of the main body 31 of the ink cartridge 30 may contact the base portions 45 and 67 as attaching process. In another words, the light attenuating portion is configured to move toward the first direction and disposed in the second position which is the exterior of the first surface in the first direction when the ink cartridge attaches to the adapter. Consequently, the plate portions 44 and 66 may slide toward the front end surface 82 of the projecting portion 80. Thus, protrusion 32 of the main body 31 may engage in the recess 99 of the adapter 90, and the adapter 90 and the ink cartridge 30 may be maintained in the engaged state.

The plate portion 46 of the light attenuating portion 43 may be detected by the optical sensor 113 during the mounting of the ink cartridge 30 having the adapter 90 to the cartridge mounting portion 110. Therefore, a detection signal outputted from the optical sensor 113 may change. Based on the change in the detection signal, the controller of the printer 10 may determine that the ink cartridge 30 has been inserted in the cartridge mounting portion 110.

Then, the plate portion 67 of the light attenuating portion 65 may pass a detecting position of the optical sensor 114. As the plate portion 67 passes the detecting position, the detection signal outputted from the optical sensor 114 may change. The controller may analyze the detection signal outputted from the optical sensor 114 when the optical sensor 113 detects the plate portion 46 of the light attenuating portion 43, e.g., when the detection signal outputted from the optical sensor 113 changes. The external shape of the ink cartridges 30 used in the printer 10 may vary based on ink colors or initial ink amounts in the ink cartridges 30. For example, one ink cartridge 30 may have the external shape as depicted in FIG. 3, and another ink cartridge 30 may have a recessed portion in an area existing on an upper part of the front wall 40 of the ink cartridge 30, e.g., an area to contact the base portion 45 of the light attenuating portion 43, wherein the recessed portion of the another ink cartridge 30 may extend along the depth direction 53. With this configuration, the front end of the plate portion 44 of the light attenuating portion 43 may be located at a different position with respect to the depth direction 53 in each ink cartridge 30 when the adapter 90 attaches to the ink cartridge 30. Therefore, during the mounting of the ink cartridge 30 having the adapter 90 to the cartridge mounting portion 110, a detecting timing of the plate portion 44 by the optical sensor 113 may be different, depending on one or more of the colors of ink and the initial amount of ink stored, among the ink cartridges 30 storing the different respective colors or the initial amount of ink. Further, for example, the dimension in the depth direction 53 of the recessed portion of the front wall 40 may be adjusted such that the optical sensor 114 detects the plate portion 66 of the light attenuating portion 65 in the one ink cartridge 30 while the optical sensor 113 detects the plate portion 44, and the optical sensor 114 does not detect the plate portion 66 of the light attenuating portion 65 in the another ink cartridge 30 while the optical sensor 113 detects the plate portion 44. With this configuration, the controller may determine one or more of the color of ink and the initial amount of in stored in the ink cartridge 30 inserted into the cartridge mounting portion 110.

After the plate portion 66 of the light attenuating portion 65 passes the detecting position of the optical sensor 114, the ink remaining amount detecting portion 33 may reach the detecting position of the optical sensor 114. Thus, the indicator 62 of the sensor arm 60 may be detected by the optical sensor 114. A detection signal outputted from the optical sensor 114 may change due to the passing of the plate portion 66 of the light attenuating portion 65 and change again due to the entry of the indicator 62 of the ink remaining amount detecting portion 33. Therefore, the controller may distinguish between the plate portion 66 of the light attenuating portion 65 and the ink remaining amount detecting portion 33 based on the changes in the detection signal outputted from the optical sensor 114.

Referring to FIG. 6, while the ink outlet portion 34 exposed to the exterior of the adapter 90 is in contact with the holding portion 121, the hollow tube 122 may be inserted in the ink outlet port 71 of the ink outlet portion 34. To mount the ink cartridge onto the cartridge mounting portion 110, first, the main body 31 of the ink cartridge 30 may be inserted into the case 101 and the hollow tube 122 may be inserted into the ink outlet port 71 to reach the ink outlet valve 70. Then, as the main body 31 is further moved in the insertion direction 56, the ink outlet valve 70 may be pressed by the hollow tube 122 and thus separated from the ink outlet port 71. After that, the ink outlet portion 34 may be inserted into the holding portion 121. Thus, the main body 31 of the ink cartridge 30 may be mounted on a predetermined position with respect to the case 101 while the ink outlet portion 34 is inserted in the holding portion 121 and the hollow tube 122 is inserted in the ink outlet port 71. The hollow tube 122 may have an ink inlet port at its protruding end. Therefore, ink may flow from the ink chamber 36 to the hollow tube 122 via the ink inlet port.

The IC substrate 74 disposed on the adapter 90 may contact the contacts 106 electrically and an electrical connection may be established between the contacts 106 and the HOT electrode, the GND electrode, and the signal electrode of the IC substrate 74, respectively. Data read from the IC substrate 74 may be used to determine the type of the ink cartridge 30, e.g., one or more of the color and the remaining amount of ink.

In another embodiment, the ink cartridge 30 and the adapter 90 may be retained in the mounting position in the case 101 by protrusions disposed on an inner surface of the case 101, respectively.

When the ink chamber 36 of the ink cartridge 30 is depleted of ink, the depleted ink cartridge 30 may be removed from the cartridge mounting portion 110 and a new ink cartridge 30 may be mounted to the cartridge mounting portion 110. Only an empty ink cartridge 30 may be replaced with a new one.

Referring to FIG. 7, to remove the ink cartridge 30 from the cartridge mounting portion 110, the main body 31 of the ink cartridge 30 may be held by the user and pulled in the removal direction 55. Thus, the engagement between the protrusion 32 of the main body 31 and the recess 99 of the adapter 90 may be detached and the ink cartridge 30 may be moved in the removal direction 55 with the adapter 90 remaining in the cartridge mounting portion 110.

In accordance with the movement of the ink cartridge 30 in the removal direction 55, the hollow tube 122 may be removed from the ink outlet portion 34 and the ink remaining amount detecting portion 33 may pass the detecting position of the optical sensor 114 in the removal direction 55. The detection signal outputted from the optical sensor 114 may change when the light attenuating portion 43 passes the detecting position of the optical sensor 114.

In accordance with the movement of the front wall 40 of the main body 31 in the removal direction 55, the base portion 45 of the light attenuating portion 43 and the base portion 67 of the light attenuating portion 65 may slide in the removal direction 55 by the urging force of the coil springs 47 and 69. Correspondingly, the plate portions 44 and 66 may slide in the removal direction 55. Further, in accordance with the separation of the front wall 40 of the main body 31 from the base portions 45 and 67, the plate portions 44 and 66 may be located at respective positions closer to the opening 112 than the detecting positions of the optical sensors 113 and 114 with respect to the removal direction 55. The detection signals of the optical sensors 113 and 114 may change in accordance with the sliding of the plate portions 44, 66. Therefore, based on the changes in the detection signals, the controller of the printer 10 may determine that the ink cartridge 30 has been removed from the cartridge mounting portion 110.

The adapter 90 may remain in the cartridge mounting portion 110 without moving in the removal direction 55. Therefore, the electrical connection established between the IC substrate 74 and the contacts 106 may be maintained. Then, the new ink cartridge 30 may be inserted into the cartridge mounting portion 110. The new ink cartridge 30 may enter the opening 98 of the adapter 90 remaining in the cartridge mounting portion while being moved in the cartridge mounting portion 110 in the insertion direction 56. Then, the ink cartridge 30 may be attached to the adapter 90 in the cartridge mounting portion 110.

During attaching of the ink cartridge 30 to the adapter 90 in the cartridge mounting portion 110, the ink outlet portion 34 and the ink remaining amount detecting portion 33 of the ink cartridge 30 may be exposed to the exterior of the adapter 90 via the openings 95 and 97, respectively. Further, the light attenuating portions 43 and 65 of the adapter 90 may slide toward the front end surface 82 of the projecting portion 80 against the urging force of the coil springs 47 and 69 by which the front wall 40 of the main body 31 of the ink cartridge 30 may contact with the base portions 45, 67. Consequently, the plate portions 44 and 66 may also slide toward the front end surface 82 of the projecting portion 80.

While the plate portions 44 and 66 slide toward the front end surface 82 of the projecting portion 80, the plate portions 44 and 66 may be detected by the optical sensors 113 and 114, respectively. Based on the change in the detection signal outputted from the optical sensor 113, the controller of the printer 10 may determine that the ink cartridge 30 has been inserted into the cartridge mounting portion 110.

Further, the controller may examine the detection signal outputted from the optical sensor 113 to determine one or more of the color and the initial amount of ink of the ink cartridge 30 newly inserted into the cartridge mounting portion 110 when the optical sensor 113 detects the plate portion 46 of the light attenuating portion 43, e.g., when the detection signal outputted from the optical sensor 113 changes.

After the light attenuating portion 43 passes the detecting position of the optical sensor 114, the ink remaining amount detecting portion 33 may reach the detecting position of the optical sensor 114. Thus, the indicator 62 of the sensor arm 60 may be detected by the optical sensor 114.

The ink outlet portion 34 of the adapter 90 that passed through the opening 97 may contact the holding portion 121 and the hollow tube 122 may be inserted into the ink outlet port 711 of the ink outlet portion 34. Then, the protrusion 32 of the main body 311 may engage the recess 99 of the adapter 90. Thus, the adapter 90 and the ink cartridge 30 may be maintained in the engaged state.

When the ink cartridge 30 is separated from the adapter 90, the light attenuating portions 43 and 65 may slide correspondingly. During the sliding of the light attenuating portions 43 and 65, the plate portions 44 and 66 may be detected by the optical sensors 113 and 114, respectively. Therefore, it may be reliably determined that the ink cartridge 30 has been replaced with a new one with respect to the adapter 90, which may remain in the cartridge mounting portion 110.

When the ink cartridge 30 is replaced with a new one, the ink cartridge 30 may be removed from the cartridge mounting portion 110 and a new ink cartridge 30 may be installed while the adapter 90 remains in the cartridge mounting portion 110. Accordingly, the IC substrate 74 of the adapter 90 may not slide over the contacts 106 repeated, and thus, the wearing of the contacts 106 may be reduced or prevented.

The plate portion 44, the base portion 45, and the coil spring 47 may be disposed at respective positions with respect to the height direction 52. With this configuration, the coil spring 47 may not interfere the path that the plate portion 44 may slide. Therefore, the light may be reliably attenuated by the plate portion 44.

Figure 8:
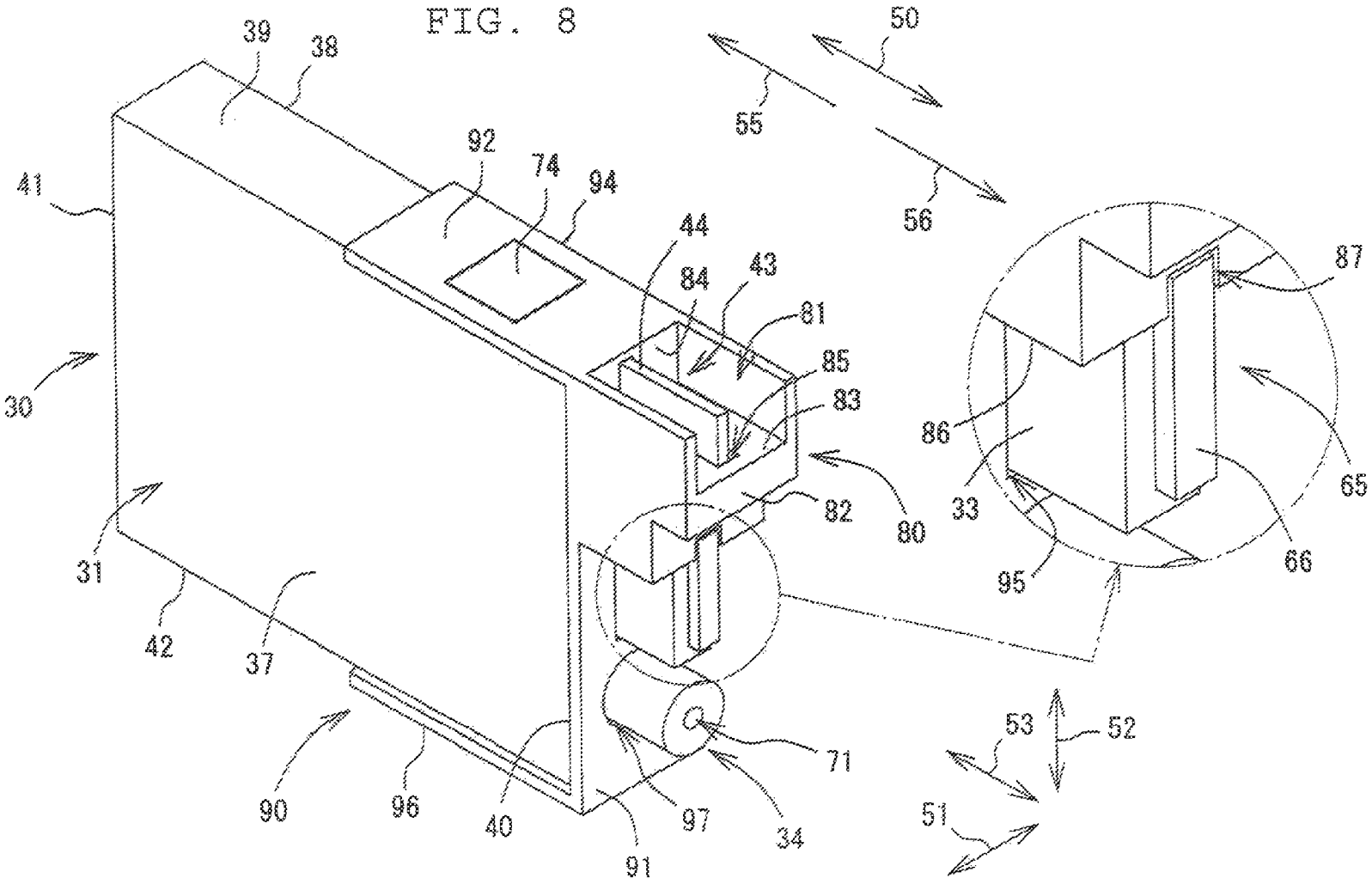
FIG. 8 is a perspective view of an ink cartridge, to which an adapter attaches, according to another embodiment of the invention.

The adapter 90 may comprise the front wall 91, the upper wall 92, the side walls 93, 94, and the lower wall 96. In another embodiment, as depicted in FIG. 8, the side wall 93 may be omitted. Similarly, the both side walls 93 and 94 may be omitted or the lower wall 96 may be omitted. Accordingly, the opening 98 of the adapter 90 into which the ink cartridge 30 may enter may comprise an opening defined by two or three walls.

The front wall 40 of the main body 31 of the ink cartridge 30 may contact the base portions 45 and 67 of the light attenuating portions 43 and 65. In another embodiment, the base portion 67 may slide against the urging force of the coil spring 69 by which the ink remaining amount detecting portion 33 may contact the base portion 67 of the light attenuating portion 65. Further, in another embodiment, the urging member may comprise a member made of resin material. The light attenuating portions 43 and 65 may comprise the coil springs 47 and 69, respectively, and may be configured to move independently. In another embodiment, the light attenuating portions 43 and 65 may have a one-piece structure and be configured to move together.

While the ink cartridge 30 attaches to the adapter 90, the side of the rear wall 41 of the main body 31 may partially protrude from the adapter 90 via the opening 98. In another embodiment, the main body 31 of the ink cartridge 30 may be entirely accommodated in the adapter 90. Further, the light attenuating portion 43 may protrude forward from or retract in the front wall 91 of the adapter 90 without the projecting portion 80.

Figure 9:
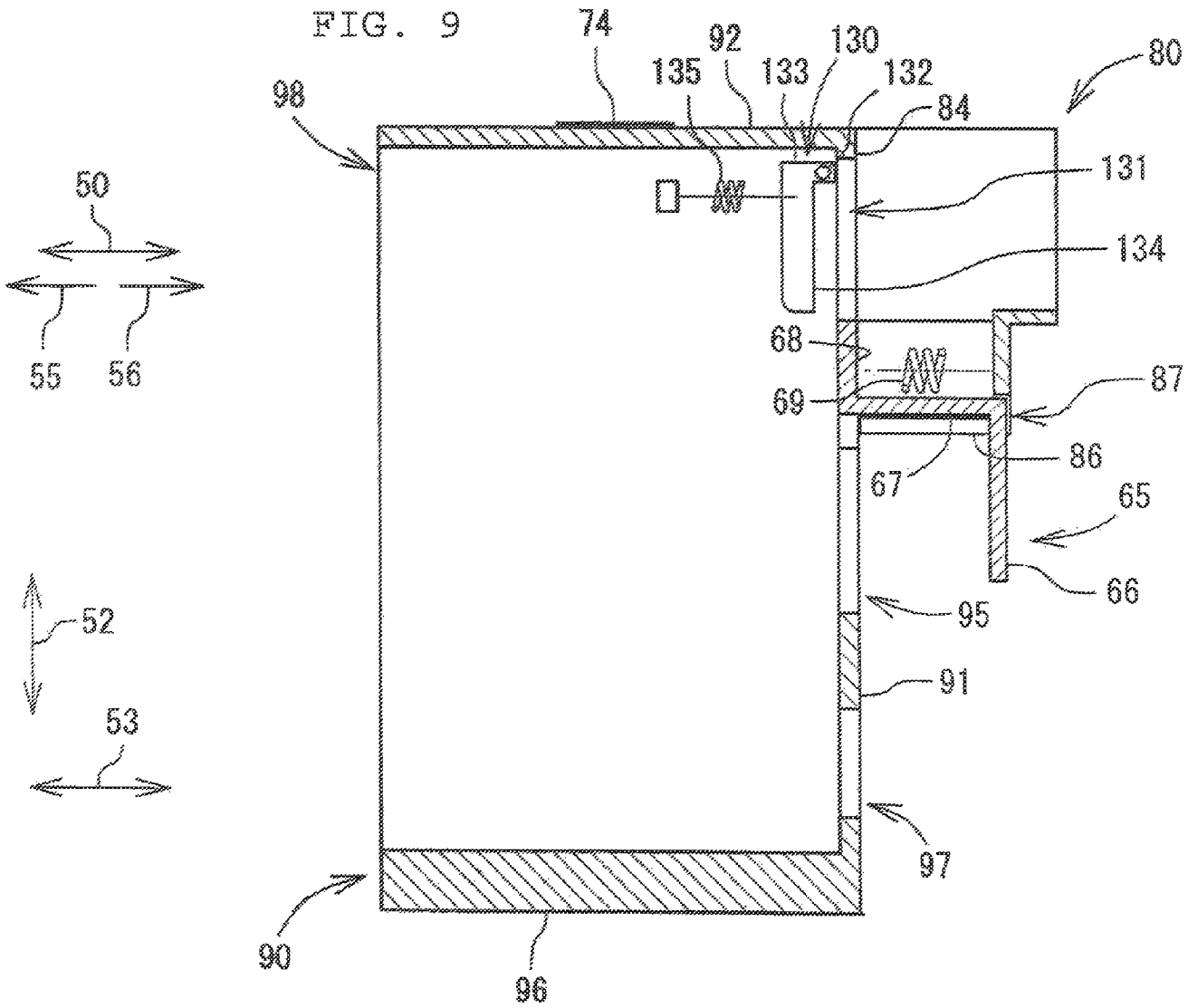
FIG. 9 is a cross-sectional view of the adapter of FIG. 8 according to an embodiment of the invention.
Figure 10:
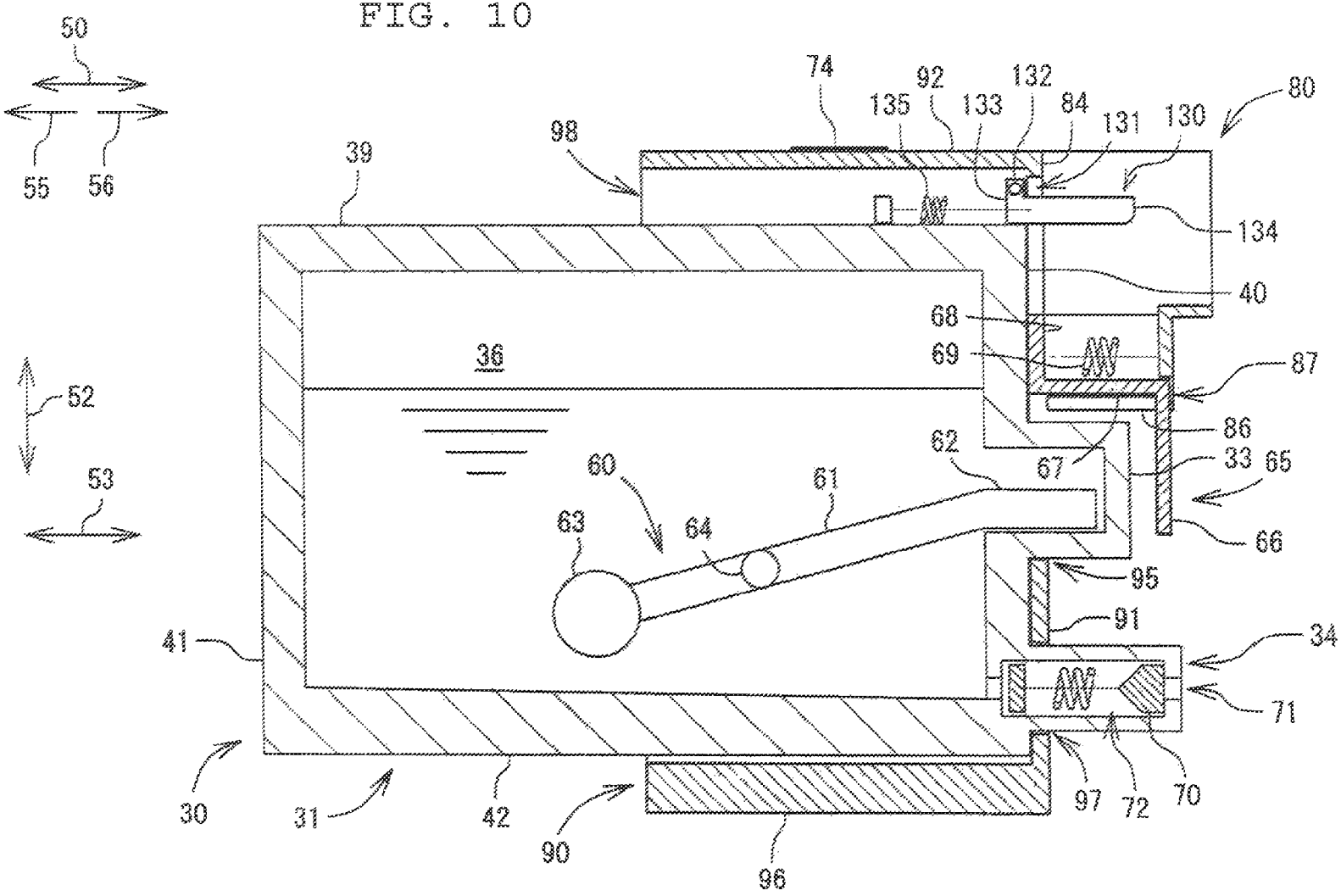
FIG. 10 is a cross-sectional view of the adapter of FIG. 8, to which the ink cartridge attaches according to an embodiment of the invention.

The light attenuating portions 43 and 65 may slide in the depth direction 53. In another embodiment, as depicted in FIGS. 9 and 10, a light attenuating portion 130 configured to pivot may be disposed at the projecting portion 80 of the adapter 90. The rear end surface 84 of the projecting portion 80 of the adapter 90 may have a slit 131 extending along the height direction 52. The light attenuating portion 130 may be disposed at a position closer to the opening 98 than the slit 131. The light attenuating portion 130 may pivot about a shaft 132 extending along the width direction 51. The light attenuating portion 130 may have an L-shape in its external shape. The light attenuating portion 130 may comprise a base portion 133 and a plate-shaped plate portion 134. The base portion 133 may be located near the shaft 132 and the plate portion 134 may be located farther from the shaft 132. The plate portion 134 may correspond to a first portion and the base portion 133 may correspond to a second portion.

Referring to FIG. 9, when the ink cartridge 30 is detached to the adapter 90, the plate portion 134 may be pulled by the coil spring 135 toward the opening 98, and thus, the plate portion 134 may be retracted inside the adapter 90. Therefore, the plate portion 134 may not protrude to the outside of the adapter 90 via the slit 131.

Referring to FIG. 10, when the ink cartridge 30 attaches to the adapter 90, the front wall 40 of the main body 31 of the ink cartridge 30 may contact the base portion 133 of the light attenuating portion 130 and pivot the light attenuating portion 130 forward about the shaft 132 such that the plate portion 134 may protrude forward through the slit 131 than the rear end surface 84 of the projecting portion 80.

Further, a portion, which may contact the main body 31 of the ink cartridge 30, of the base portion 133 may not interfere with the path that the plate portion 134 of the light attenuating portion 130 may slide. Therefore, the light may be reliably attenuated by the plate portion 134.

The light attenuating portions 43 and 65 may be configured to slide by contacting the main body 31 of the ink cartridge 30. In another embodiment, the light attenuating portions 43 and 65 may slide by contacting a cover 140 disposed at the cartridge mounting portion 110.

Figure 11:
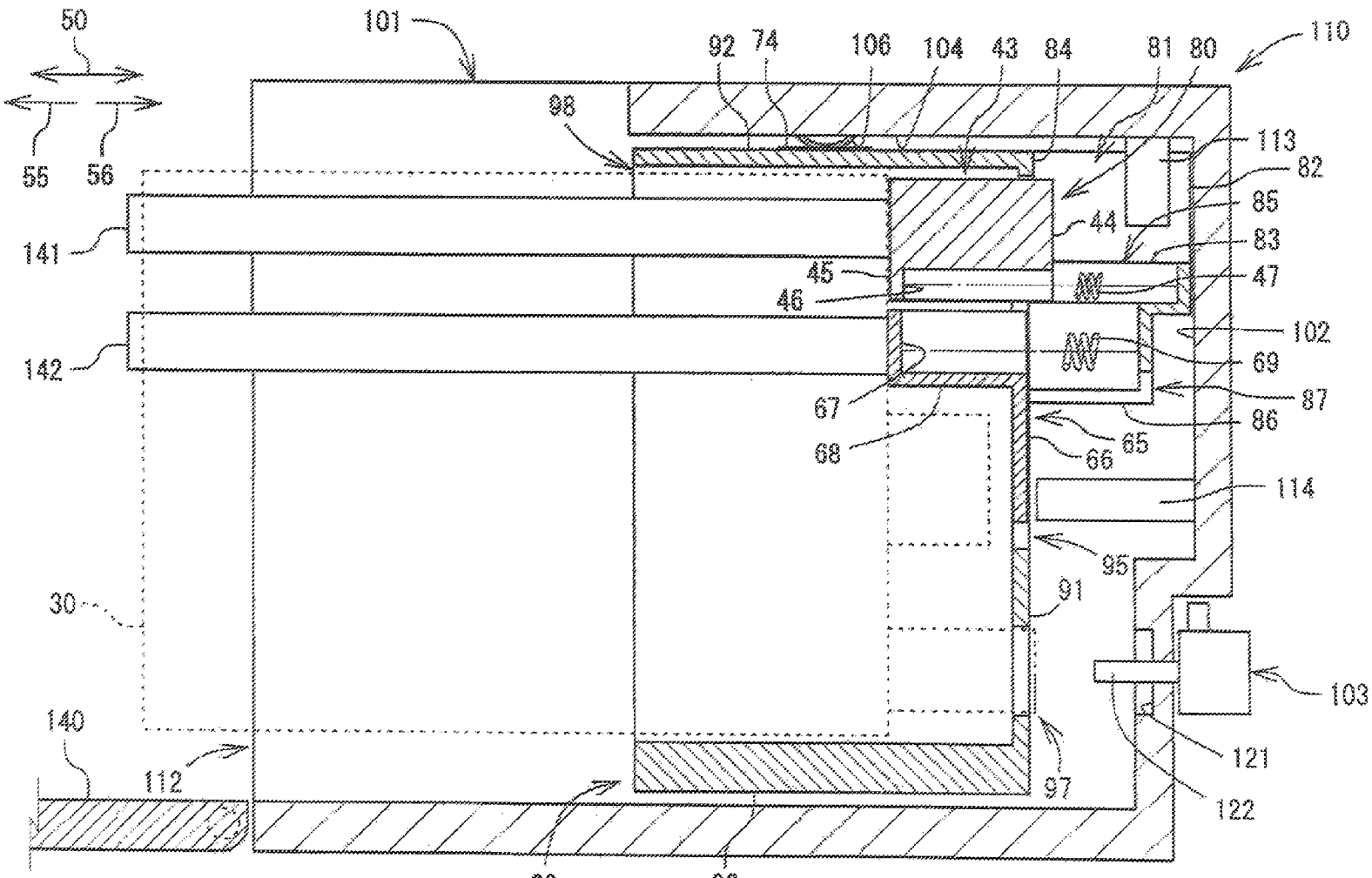
FIG. 11 is a cross-sectional view of an adapter mounted to a cartridge mounting portion according to still another embodiment of the invention.
Figure 12:
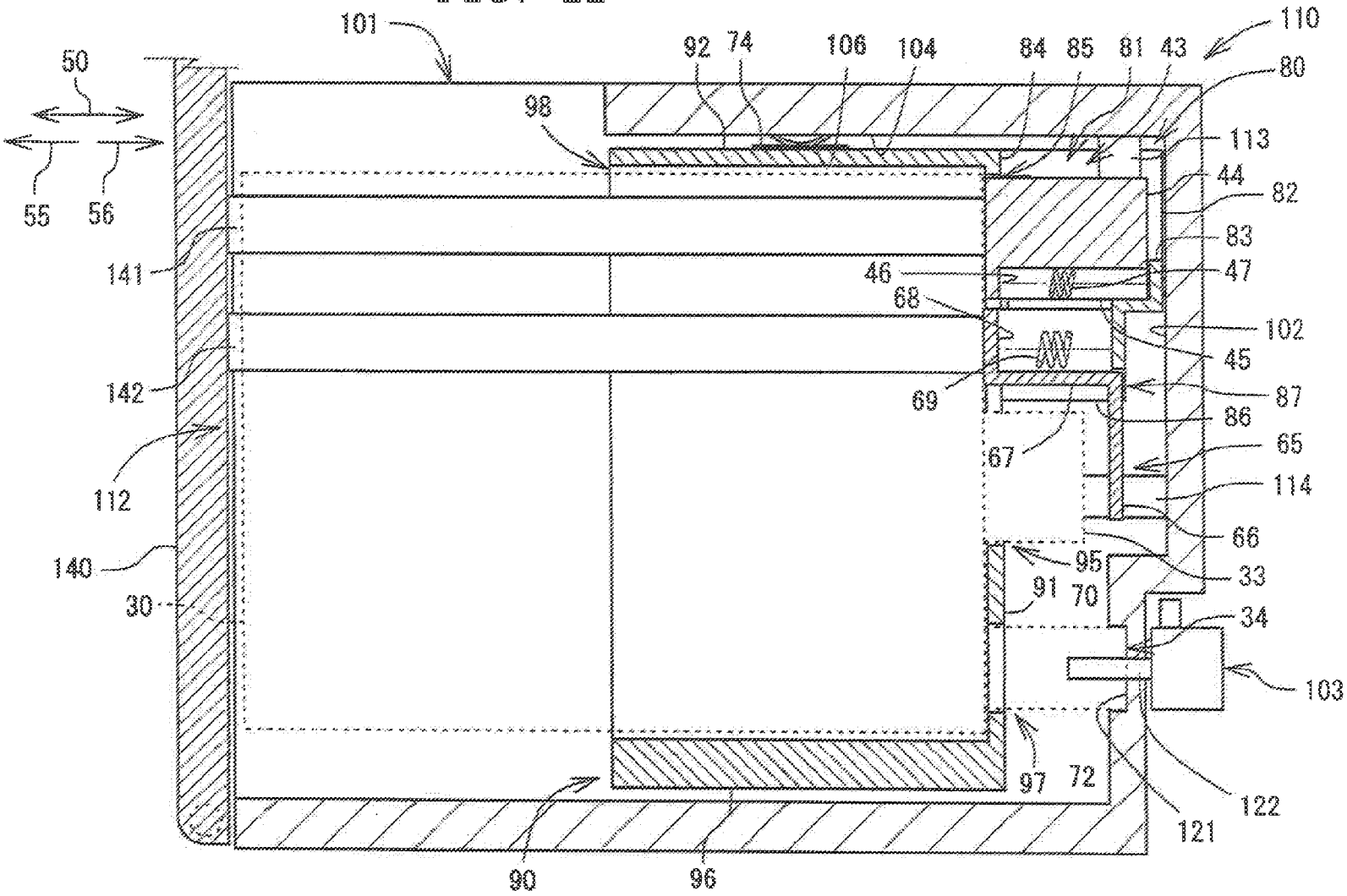
FIG. 12 is a cross-sectional view of the adapter of FIG. 11 and an ink cartridge mounted to a cartridge mounting portion according to an embodiment of the invention.

Referring to FIG. 11, the light attenuating portion 43 may comprise a contact portion 141, e.g., extended member, that may protrude from the adapter 90 via the opening 98 and extend beyond the opening 112 of the cartridge mounting portion 110. Similarly, the light attenuating portion 65 may comprise a contact portion 142 that may protrude from the adapter 90 via the opening 98 and extend beyond the opening 112 of the cartridge mounting portion 110. Referring to FIGS. 11 and 12, the ink cartridge 30, the contact portions 141 and 142 may have a plate-like shape that may be thin in the width direction 51 and may be disposed at respective positions, such that the contact portions 141 and 142 may not interfere with the ink cartridge 30.

Referring to FIGS. 11 and 12, the adapter 90 may not comprise the recess 99 and the main body 31 of the ink cartridge 30 may not comprise the protrusion 32. The ink cartridge 30 inserted into the adapter 90 may not be maintained in the state in which the ink cartridge 30 may be completely attached to the adapter 90 due to the urging force of the coil springs 47 and 69. That is, in this state, the light attenuating portions 43 and 65 may not be located at the respective positions in which the light attenuating portions 43 and 65 may be detectable by the optical sensors 113 and 114, respectively. Therefore, unless an external force is applied to the ink cartridge 30, the ink cartridge 30 may be shifted in the removal direction 55 by a sliding amount of the light attenuating portions 43 and 65 from the position where the ink cartridge 30 may be completely attached to the adapter 90. Accordingly, even when the ink cartridge 30 attaches to the adapter 90, the light attenuating portions 43 and 65 may not slide to the respective detecting positions of the optical sensors 113 and 114 unless an external force is applied to the ink cartridge 30 against the urging force of the coil springs 47 and 69.

The cartridge mounting portion 110 may comprise the cover 140 that may be configured to pivot about a lower end of the case 101 on the opening 112 side to open and close the opening 112. To insert the ink cartridge 30 into the cartridge mounting portion 110, as depicted in FIG. 11, an upper end side of the cover 140 may be tilted toward the removal direction 55 to open the opening 112. To complete the mounting of the ink cartridge 30 is completed, as depicted in FIG. 12, the upper end side of the cover 140 may be moved upward to close the opening 112. One of the cover 140 and the case 101 may comprise a locking mechanism configured to retain the cover 140 to close the opening 112.

Referring to FIG. 11, when the cover 140 is tilted to open the opening 112, the ink cartridge 30 may be inserted into the cartridge mounting portion 110. While the main body 31 of the ink cartridge 30 contacts the light attenuating portions 43 and 65, the ink cartridge 30 may be located at the position shifted by the sliding amount of the light attenuating portions 43 and 65 in the removal direction 55 from the position where the ink cartridge 30 may be completely attached to the adapter 90 due to the urging force of the coil springs 47 and 69.

Referring to FIG. 12, during the closing of the cover 140 to close the opening 112, the cover 140 may contact the contact portions 141 and 142 of the light attenuating portions 43 and 65 and the rear wall 41 of the main body 31 of the ink cartridge 30. Thus, the main body 31 of the ink cartridge 30 may be moved in the insertion direction 56 by a closing force of the cover 140 against the urging force of the coil springs 47 and 69 e.g., biasing member. In accordance with the movement of the main body 31, the light attenuating portions 43 and 65 may be moved to the respective detecting positions of the optical sensors 113 and 114. Then, the cover 140 may be retained to close the opening 112. Thus, the ink cartridge 30 may be maintained in the state where the ink remaining amount detecting portion 33 may be detectable by the optical sensor 114 and the connector 103 may be connected with the ink outlet portion 34. When the cover 140 is opened or closed while the adapter 90 and the ink cartridge 30 are mounted in the cartridge mounting portion 110, the state of the light attenuating portions 43 and 65 may be changed.

While the invention has been described in connection with various exemplary structures and illustrative embodiments, it will be understood by those skilled in the art that other variations and modifications of the structures, configurations, and embodiments described above may be made without departing from the scope of the invention. For example, this application may comprise many possible combinations of the various elements and features disclosed herein, and the particular elements and features presented in the claims and disclosed above may be combined with each other in other ways within the scope of the application, such that the application should be recognized as also directed to other embodiments comprising other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. An adapter configured to be removably attached in an attached state with a cartridge mounting portion of a printing device and a cartridge comprising a first main body comprising a first surface facing a first direction and a chamber configured to store ink, and an ink outlet portion disposed on the first surface of the first main body and configured to direct the ink from the chamber to an exterior of the first main body, the adapter comprising:

a second main body;

a second surface facing a second direction intersecting to the first surface;

an electrical interface is disposed on the second surface; and a movable portion configured to move with respect to the electrical interface between a first position and a second position, wherein, when the adapter attaches to the ink cartridge, in an attached state, the movable portion is configured to move from the first position to the second position, the movable portion is downstream from the first surface in the first direction, and wherein the movable portion is disposed closer to the electrical interface than the ink outlet portion in the second direction and the electrical interface is disposed downstream from the ink movable portion in the second direction in the attached state.

2. The adapter according to claim 1, wherein the second main body comprises a first opening, and the movable portion protrudes through the first opening in the first direction.

3. The adapter according to claim 1, wherein the adapter comprises a further movable portion configured to move between a third position and a fourth position, the further movable portion being disposed upstream from the movable portion in the second direction.

4. The adapter according to claim 3, wherein the movable portion is configured to move between the first position and the second position along the first direction, and wherein the further movable portion is configured to move between the third position and the fourth position along the first direction.

5. The adapter according to claim 3, wherein the further movable portion comprises a further light attenuating portion.

6. The adapter according to claim 5, wherein the further movable portion comprises a contact portion disposed downstream from the further light attenuating portion in the second direction and configured to contact the ink cartridge.

7. The adapter according to claim 6, wherein the leading end of the light attenuating portion is disposed downstream from the contact portion in the first direction.

8. The adapter according to claim 3, wherein the leading end of the movable portion extends further from the first surface than the leading end of the further movable portion extends from the first surface when the movable portion is disposed in the second position and the further movable portion is disposed in the fourth position.

9. The adapter according to claim 1, wherein the movable portion is configured to pivot between the first position and the second position.

10. The adapter according to claim 1, wherein the adapter comprises a first wall facing the first direction and a second opening formed in the first wall, and wherein the second opening is configured to expose the ink outlet portion to the exterior of the second main body in the attached state.

11. The adapter according to claim 1, wherein the adapter further comprises a biasing portion configured to bias the movable portion toward the first position when the movable portion is away from the first position.

12. The adapter according to claim 1, wherein a leading edge of the movable portion is disposed downstream from the ink outlet portion in the first direction in the attached state.

13. The adapter according to claim 12, wherein a leading edge of the movable portion is disposed downstream from the ink outlet portion in the first direction in the attached state.

14. An adapter comprising:

a main body comprising:

a first surface facing a first direction; and a second surface facing a second direction intersecting the first direction, the second surface extending from the first surface in an opposite direction that is opposite to the first direction;

an electrical interface disposed on the first surface, the electrical interface facing the first direction; and a movable portion configured to move with respect to the electrical interface along the second direction, the movable portion being disposed further than the electrical interface in the opposite direction, wherein the movable portion is configured to move between the first position and the second position, and the first position and the second position are positioned further than the electrical interface in the opposite direction.

15. The adapter according to claim 14, wherein the movable portion is configured to move between a first position and a second position downstream from the first position in the second direction.

16. The adapter according to claim 15, wherein the adapter comprises a further movable portion, wherein the further movable portion is configured to move between a third position and a fourth position downstream from the third position in the second direction, and wherein the further movable portion comprises a further light attenuating portion.

17. The adapter according to claim 16, wherein the further movable portion comprises a wall disposed downstream from the further light attenuating portion in the first direction.

18. The adapter according to claim 17, wherein the further light attenuating portion is disposed downstream from the wall in the second direction.

19. The adapter according to claim 15, wherein the adapter comprises a biasing portion configured to bias the movable portion toward the first position.

20. The adapter according to claim 15, wherein the movable portion is configured to pivot between the first position and the second position.

21. The adapter according to claim 14, wherein the movable portion is configured to be removably attached to a printing device.

22. The ink containing device comprising:

a main body comprising a particular surface facing a particular direction and a chamber configured to store ink;

a further surface facing a further direction intersecting the particular direction;

an electrical interface disposed on the further surface;

an ink outlet portion disposed on the particular surface of the main body and configured to direct the ink from the chamber to an exterior of the main body;

a movable portion configured to move with respect to the electrical interface, wherein the movable portion is configured to move between a first position and a second position, and wherein the movable portion is disposed between the ink outlet portion and the electrical interface along the further direction.

23. The ink containing device according to claim 22, wherein the main body comprises a first opening, and the movable portion protrudes through the first opening in the first direction.

24. The ink containing device according to claim 23 further comprising a further movable portion configured to move between a third position and a fourth position.

25. The ink containing device according to claim 23 further comprising a bias portion configured to bias the movable portion toward the first position when the movable portion is away from the first position.

26. The ink containing device according to claim 23, wherein the movable portion is configured to move between a first position and a second position along the particular direction.

27. The ink containing device according to claim 23, wherein the movable portion is configured to pivot between the first position and the second position.

28. The ink containing device according to claim 22, wherein a leading edge of the movable portion is disposed downstream from the ink outlet portion in the first direction in the attached state.

* * * * *